US010368617B2

(12) United States Patent
Ma

(10) Patent No.: US 10,368,617 B2
(45) Date of Patent: Aug. 6, 2019

(54) UMBRELLA ASSEMBLY SET UP DEVICES

(71) Applicant: Zhun-An Ma, Arcadia, CA (US)

(72) Inventor: Zhun-An Ma, Arcadia, CA (US)

( * ) Notice: Subject to any disclaimer, the term of this patent is extended or adjusted under 35 U.S.C. 154(b) by 0 days.

(21) Appl. No.: 15/792,121

(22) Filed: Oct. 24, 2017

(65) Prior Publication Data

US 2018/0112433 A1 Apr. 26, 2018

Related U.S. Application Data

(60) Provisional application No. 62/412,401, filed on Oct. 25, 2016.

(51) Int. Cl.

| | |
|---|---|
| ***A45B 25/14*** | (2006.01) |
| ***E04H 15/28*** | (2006.01) |
| ***A45B 23/00*** | (2006.01) |

(52) U.S. Cl.

CPC ..... *A45B 25/14* (2013.01); *A45B 23/00* (2013.01); *E04H 15/28* (2013.01); *A45B 2200/1081* (2013.01)

(58) Field of Classification Search

CPC ..... A45B 23/00; A45B 17/00; A45B 25/14; A45B 25/00; A45B 2023/0031; A45B 25/08; A45B 2200/1081; E04H 15/28

USPC ..... 135/16, 20.3, 21, 25.4, 37, 39, 40, 98

See application file for complete search history.

(56) References Cited

U.S. PATENT DOCUMENTS

| | | | |
|---|---|---|---|
| 229,685 | A | 7/1880 | Ege |
| 521,222 | A | 6/1894 | Schof et al. |
| 620,815 | A | 3/1899 | Warren |
| 776,352 | A | 11/1904 | Rogers |
| 928,169 | A | 7/1909 | Bardon |
| 1,001,076 | A | 8/1911 | Redford |
| 1,207,649 | A | 12/1916 | South |
| D56,043 | S | 8/1920 | Weinberg et al. |

(Continued)

FOREIGN PATENT DOCUMENTS

| | | |
|---|---|---|
| AU | 702 172 | 2/1999 |
| DE | 580503 | 7/1933 |

(Continued)

OTHER PUBLICATIONS

Activa Leisure, 2010 Product Catalog.
Treasure Garden, 2010 Product Catalog.

*Primary Examiner* — Winnie Yip
(74) *Attorney, Agent, or Firm* — Knobbe Martens Olson & Bear LLP

(57) ABSTRACT

An umbrella is provided that has a support pole, a canopy frame, and a set up assembly. The canopy frame is coupled with the support pole. The set up assembly is coupled with the canopy frame. The set up assembly is configured to open the canopy frame. The set up assembly has an actuator handle, a recess disposed on or in the support pole, and a locking pin. The locking pin is coupled with the handle and is moveable by the handle along a first direction between a first position and a second position. In the first position, the locking pin is disposed in the recess. In the second position the locking pin is spaced away from the recess. Movement of the locking pin along the umbrella pole adjacent to the recess in a second direction transverse to the first direction moves the locking pin between the first position and the second position in the first direction without moving the actuator handle in the first direction.

20 Claims, 18 Drawing Sheets

(56) References Cited

U.S. PATENT DOCUMENTS

| | | | | |
|---|---|---|---|---|
| 1,589,299 | A | 6/1926 | Metzger | |
| 1,630,870 | A | 5/1927 | Strunck | |
| 1,712,430 | A | 5/1929 | Giszczynski | |
| 1,908,453 | A | 5/1933 | Schmidt | |
| 2,168,188 | A | 8/1939 | Bernhard | |
| 2,185,466 | A | 1/1940 | Jostes | |
| 2,474,516 | A | 6/1949 | Daniel | |
| 2,507,919 | A | 5/1950 | Mazzeo | |
| 2,584,283 | A | 2/1952 | Masoner | |
| 2,661,752 | A | 12/1953 | Kampf et al. | |
| 2,705,967 | A | 4/1955 | Zimmermann et al. | |
| 2,709,059 | A | 5/1955 | Lear | |
| 2,762,243 | A | 9/1956 | Knosp et al. | |
| 2,860,647 | A | 11/1958 | Negri | |
| 2,906,277 | A | 9/1959 | Militano | |
| 3,016,910 | A | 1/1962 | Rosenkaimer | |
| 3,672,381 | A | 6/1972 | Kida et al. | |
| 3,787,137 | A | 1/1974 | Renner | |
| 3,828,805 | A | 8/1974 | Thur | |
| 3,924,834 | A | 12/1975 | Young | |
| 4,030,514 | A | 6/1977 | Schultes | |
| 4,080,976 | A | 3/1978 | Hirai | |
| 4,084,600 | A | 4/1978 | dePolo | |
| 4,119,290 | A | 10/1978 | Gies | |
| 4,144,900 | A | 3/1979 | Kinski | |
| 4,259,974 | A | 4/1981 | dePolo | |
| 4,474,200 | A | 10/1984 | Kida | |
| 4,474,201 | A | 10/1984 | Kida | |
| 4,650,145 | A | 3/1987 | Natzel et al. | |
| 4,697,606 | A | 10/1987 | Ma | |
| 4,720,071 | A | 1/1988 | Nelson et al. | |
| 4,763,679 | A | 8/1988 | Lerch | |
| 4,823,821 | A | 4/1989 | Day | |
| 4,925,142 | A | 5/1990 | Farmer | |
| H000906 | H | 4/1991 | Baggett et al. | |
| 5,036,872 | A | 8/1991 | Huang | |
| 5,186,570 | A | 2/1993 | Graf | |
| 5,213,122 | A | 5/1993 | Grady, II | |
| 5,224,505 | A | 7/1993 | Wu | |
| 5,232,304 | A | 8/1993 | Huang | |
| 5,329,953 | A | 7/1994 | Becher | |
| 5,385,323 | A | 1/1995 | Garelick | |
| 5,483,985 | A | 1/1996 | Yu | |
| 5,564,453 | A | 10/1996 | Steiner | |
| 5,575,527 | A | 11/1996 | Pfister | |
| 5,617,888 | A | 4/1997 | Wu | |
| 5,632,464 | A | 5/1997 | Aberle | |
| 5,640,984 | A | 6/1997 | Dubunsky | |
| 5,655,557 | A | 8/1997 | Martin | |
| 5,740,824 | A | 4/1998 | Tang | |
| 5,746,152 | A | 5/1998 | Huse | |
| 5,752,534 | A | 5/1998 | Becher | |
| 5,782,256 | A | 7/1998 | Bradley | |
| 5,842,493 | A | 12/1998 | Yakubisin | |
| 5,882,077 | A | 3/1999 | Gebhard | |
| 5,884,645 | A | 3/1999 | Chen et al. | |
| 6,039,063 | A | 3/2000 | Lin et al. | |
| 6,076,540 | A | 6/2000 | You | |
| 6,082,383 | A | 7/2000 | Wilson | |
| 6,092,771 | A | 7/2000 | Fich | |
| 6,095,169 | A | 8/2000 | Lin et al. | |
| 6,196,244 | B1 | 3/2001 | Haddad et al. | |
| 6,311,707 | B1 | 11/2001 | Wu et al. | |
| 6,374,840 | B1 | 4/2002 | Ma | |
| 6,386,214 | B1 | 5/2002 | Clarke | |
| 6,390,107 | B1 | 5/2002 | Lin et al. | |
| 6,443,406 | B1 | 9/2002 | Frank | |
| 6,543,464 | B1 | 4/2003 | Grady, II | |
| 6,626,199 | B2 | 9/2003 | Lin et al. | |
| D497,478 | S | 10/2004 | Clarke | |
| 6,820,847 | B2 | 11/2004 | Camarota et al. | |
| 6,948,283 | B2 | 9/2005 | Burkhart et al. | |
| 6,988,504 | B1 * | 1/2006 | Goldwitz | A45B 23/00 135/20.1 |
| 7,350,532 | B2 | 4/2008 | Wu | |
| 7,380,563 | B2 | 6/2008 | Seo | |
| 7,401,618 | B2 | 7/2008 | Caldwell | |
| 7,628,164 | B2 | 12/2009 | Joen-An Ma | |
| 7,798,161 | B2 | 9/2010 | Ma | |
| 7,886,755 | B2 * | 2/2011 | Tung | A45B 23/00 135/20.1 |
| 7,900,643 | B2 | 3/2011 | Ma | |
| 7,963,293 | B2 | 6/2011 | Ma | |
| 7,980,261 | B2 * | 7/2011 | Glatz | A45B 19/04 135/20.1 |
| 8,113,223 | B2 * | 2/2012 | Wang | A45B 19/04 135/20.1 |
| 8,251,078 | B2 | 8/2012 | Ma | |
| 8,555,906 | B2 | 10/2013 | Ma | |
| 9,004,087 | B2 * | 4/2015 | Ma | A45B 25/165 135/20.3 |
| 9,220,325 | B2 * | 12/2015 | Ma | A45B 17/00 |
| 9,504,299 | B2 * | 11/2016 | Ma | A45B 19/06 |
| 10,136,709 | B2 * | 11/2018 | Ma | A45B 23/00 |
| 2003/0005952 | A1 | 1/2003 | Chen | |
| 2003/0098050 | A1 | 5/2003 | Lee | |
| 2004/0035452 | A1 | 2/2004 | Ma | |
| 2004/0055628 | A1 | 3/2004 | Yu | |
| 2004/0182429 | A1 | 9/2004 | Chen | |
| 2005/0028853 | A1 | 2/2005 | Houtan | |
| 2005/0045217 | A1 | 3/2005 | Clarke | |
| 2005/0268952 | A1 | 12/2005 | Ma | |
| 2006/0151018 | A1 | 7/2006 | Wilson | |
| 2006/0243311 | A1 * | 11/2006 | Glatz | A45B 23/00 135/120.2 |
| 2008/0066793 | A1 * | 3/2008 | Ma | A45B 19/04 135/28 |
| 2008/0236640 | A1 * | 10/2008 | Huali | A45B 23/00 135/20.3 |
| 2010/0269871 | A1 * | 10/2010 | Ma | A45B 25/08 135/20.3 |

FOREIGN PATENT DOCUMENTS

| | | |
|---|---|---|
| DE | 203 06 406 | 7/1994 |
| DE | 20 2005 011579 | 7/2006 |
| EP | 0 392 989 | 3/1990 |
| EP | 1 654 952 | 5/2006 |
| FR | 2 554 490 | 5/1985 |
| FR | 2 687 714 | 8/1993 |
| GB | 22218 | 9/1910 |
| JP | 5031003 | 2/1993 |
| NL | 9 500 219 | 9/1996 |
| WO | WO 2006/076270 | 7/2006 |
| WO | WO 2007/018492 | 2/2007 |

* cited by examiner

240

UMBRELLA ASSEMBLY SET UP DEVICES

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 C.F.R. § 1.57.

BACKGROUND OF THE INVENTION

Field of the Invention

The present application relates to umbrellas and to an umbrella having an umbrella handle that can be actuated to engage with and disengage from an umbrella pole to maintain a canopy of the umbrella in a selected position.

Description of the Related Art

Foldable umbrellas and canopies allow a user to open a shade structure to provide shade over a given area and to close the shade structure. When closed the umbrellas and canopies are low profile to be out of the way or protected from the elements. The shade structure can include a frame mechanism, such as including a plurality of jointed ribs and hubs that open or extend and close or fold under movement of a cord or in response to gravity. Usually the frame mechanism operates by raising a lower hub that is moveable relative to an upper hub.

Some umbrellas operate with a moveable upper hub. In such umbrellas the position of the upper hub can be at a higher elevation in a closed position than in an open position. In other words as the upper hub is lowered the frame mechanism opens up to stretch a shade member such as a canopy fabric. Raising the upper hub can be achieved by a solid actuating member capable of bearing a compressive load.

Larger umbrellas have larger frame mechanisms, heavier shade members and if present longer actuating members. All of this contributes to greater weight. While handles with detent arrangements and friction plates can be used to actuate and hold these heavy components at selected positions such structures can be difficult to operate or subject to wear due to load conditions.

SUMMARY OF THE INVENTION

New handles and retention devices are needed to improve the load bearing, durability and human factors considerations.

In one embodiment an umbrella is provided that includes a support pole, a canopy frame, an actuator, and a locking device. The support pole has a lower portion that has a lower end and an upper portion that has an upper end. The canopy frame has a first rib, an upper hub, a second rib, and a lower hub. The upper hub is coupled with a first end of the first rib. The lower hub is coupled with a first end of the second rib. The second rib has a second end coupled with the first rib. The actuator assembly has a rod disposed along the support pole, a traveler, and a handle pivotably coupled with the traveler. The rod has a first end coupled with the upper hub and a second end disposed below from the upper hub. The traveler can be coupled with the second end of the rod. The handle is pivotably coupled with the traveler. The locking device has a plurality of spaced apart ratchet features and a locking pin. The locking pin is moveable relative to the traveler. A first end of locking pin has a first position disposed between adjacent ratchet features and a second position spaced away from the ratchet features. The locking pin has a second end coupled with the handle. The handle is configured to pivot relative to the traveler to move the locking pin from the first position the second position to disengage the pin from the ratchet features.

In another embodiment an umbrella is provided that includes a support pole, a canopy frame, a movement assembly, and a locking device. The support pole has a lower portion that has a lower end and an upper portion that has an upper end. The canopy frame is coupled with the support pole. The canopy frame has an upper hub coupled with a first end of a first rib and a lower hub coupled with a first end of a second rib. The second rib has a second end coupled with the first rib. The movement assembly has a rod, a traveler and a handle. The rod has a first end coupled with the canopy frame and a second end moveable along the support pole. The traveler is coupled with the second end of the rod. The handle is pivotably coupled with the traveler. The locking device has a plurality of spaced apart recesses and a locking pin moveable relative to the traveler. A first end of locking pin has a first position disposed in any one of the plurality of recesses and a second position. The second position is spaced away from all of the recesses. The locking pin has a second end coupled with the handle. The handle is configured to move relative to the traveler to move the locking pin from the first position the second position to disengage the locking pin from the spaced apart recesses.

In another embodiment, an umbrella is provided that has a support pole, a canopy frame, and a set up assembly. The canopy frame is coupled with the support pole. The set up assembly is coupled with the canopy frame. The set up assembly is configured to open the canopy frame. The set up assembly has an actuator handle, a recess disposed on or in the support pole, and a locking pin. The locking pin is coupled with the handle and is moveable by the handle along a first direction between a first position and a second position. In the first position, the locking pin is disposed in the recess. In the second position the locking pin is spaced away from the recess. Movement of the locking pin along the umbrella pole adjacent to the recess in a second direction transverse to the first direction moves the locking pin between the first position and the second position in the first direction without moving the actuator handle in the first direction.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments. The following is a brief description of each of the drawings.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Figure 1:
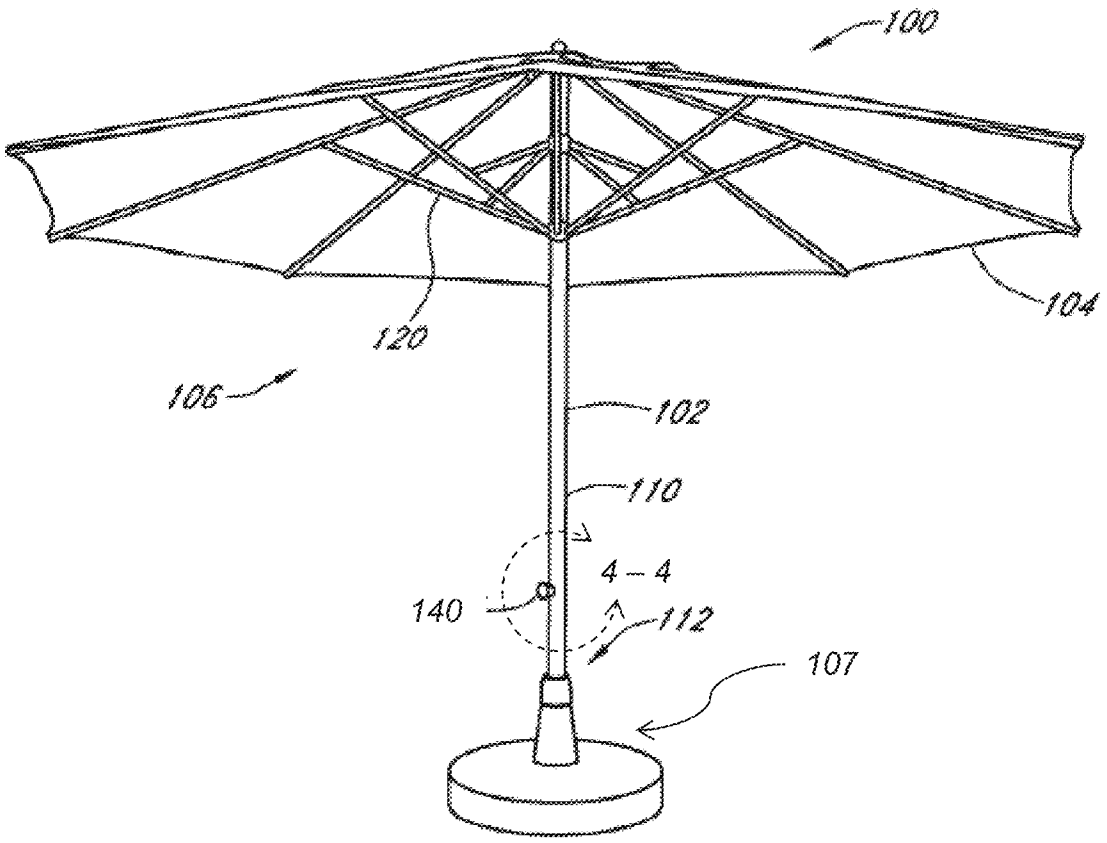
FIG. 1 is a perspective view of one embodiment of an umbrella having an opening/closing device with the umbrella in an open configuration.
Figure 2:
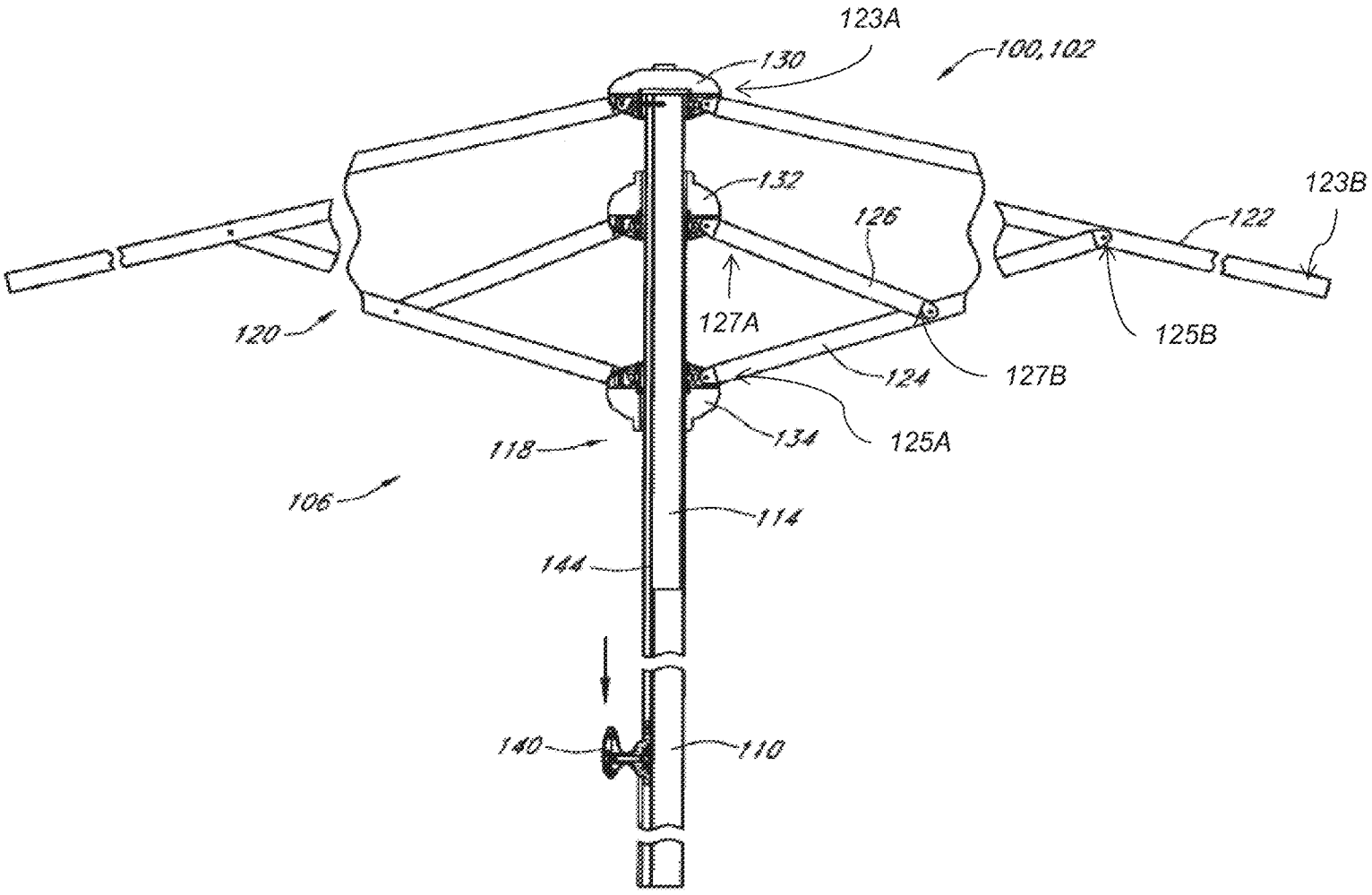
FIG. 2 is a partial cross-sectional view of one embodiment of an assembly taken through a longitudinal central portion of the assembly, the assembly being shown in an open configuration.

FIG. 1 shows in perspective view one embodiment of an umbrella or umbrella assembly 100. FIGS. 1 and 2 show the umbrella assembly 100 in an open configuration 106. The open configuration provides shade and shelter from the elements to users of the umbrella assembly 100. The umbrella assembly 100 can also be positioned in a closed or collapsed configuration 108 as illustrated in partial section view in FIG. 3.

In this embodiment, the umbrella assembly 100 comprises a canopy frame 102 and a shade member 104 that is attached to and supported by the canopy frame 102. The shade member 104 can comprise an at least partially flexible material, such as fabric and/or a plastic film. The shade member 104 offers shade protection from sunlight, as well as at least partial shelter from the elements, e.g., rain, bird droppings, tree sap, etc. The shade member 104 also can comprise materials having weather and sun resistant characteristics to provide extended durability and usage in outdoor settings. The shade member 104 also can be provided in an attractive color scheme or pattern and/or with a logo or other design to the user's taste.

Figure 3:
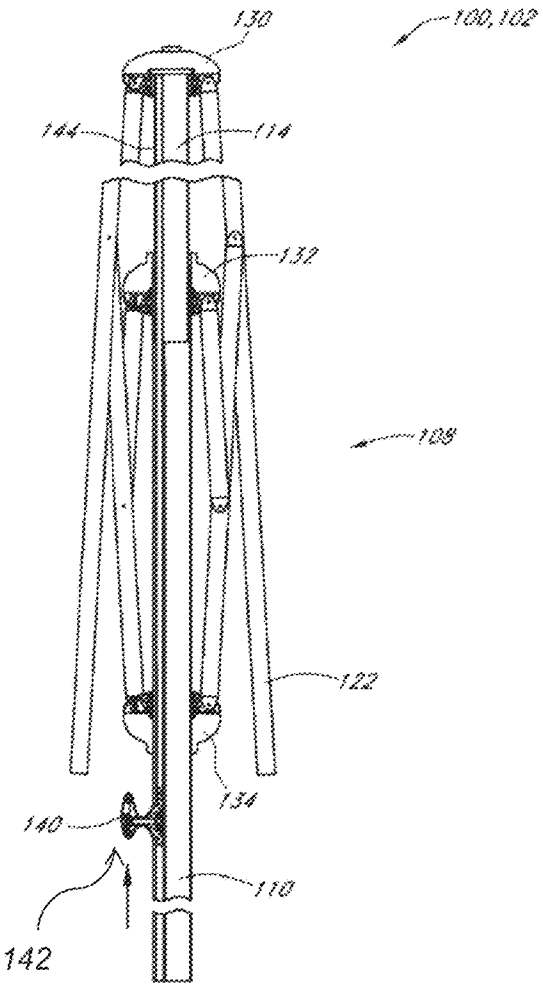
FIG. 3 is a cross-sectional view similar to that of FIG. 2, the frame assembly and umbrella being shown in a closed configuration.

The canopy frame 102 is configured in one embodiment to raise or open the shade member 104 to the open configuration 106 illustrated in FIGS. 1 and 2 and to lower or close the canopy to the closed configuration 108 as illustrated in FIG. 3. This aspect provides the advantage that the physical envelope encompassed by the umbrella assembly 100 in the closed configuration 108 is reduced to thereby facilitate storage, movement and/or packaging for shipment of the umbrella assembly 100. The canopy frame 102 also provides the ability to conveniently open the umbrella assembly 100 with attached shade member 104 when the umbrella assembly 100 is to be used. Several embodiments of the canopy frame 102 will be described with operating characteristics and advantages thereof discussed in greater detail below.

In one embodiment, the canopy frame 102 of the umbrella assembly 100 comprises a support pole or member 110. The support pole 110 is configured to support and elevate or extend the canopy frame 102 such that the shade member 104 when extended can provide a sheltered and shaded region underneath. As discussed further below, the support pole 110 can be an assembly of a plurality of segments or components. In some arrangements, the support pole 110 includes an upper pole segment 110A and a lower pole segment 110B of a support pole assembly. As discussed further below in connection with FIGS. 7C and 7D, the interior configuration of the upper pole segment 110A can be different from the lower pole segment 110B.

In one embodiment, the support pole 110 is provided with a mounting end 112 which is adapted for attachment or mounting in place for use of the umbrella assembly 100. The mounting end 112 can be a lower portion of the support pole 100, e.g., including a lower end thereof. FIG. 1 illustrates that one embodiment of the mounting end 112 is configured for attachment to a pedestal or base 107 to rest on the ground, a patio deck, a lawn, or the like. The base 107 could be built in or coupled with anchored fasteners in some embodiments. It will be understood that this is simply an illustration of one embodiment of the mounting end 112. In other embodiments, the mounting end 112 is configured for direct attachment or mounting in a patio, to a bracket on a vertically or horizontally extending building surface, or the like. The attachment of the mounting end 112 is in certain embodiments of a permanent or semi-permanent nature and in other embodiments comprises a releasable attachment. The attachment of the mounting end 112 in certain embodiments restrains both translation and rotation of the support pole 110. In other embodiments, the mounting end 112 is configured to allow limited rotational movement, e.g., a swiveling type movement. Thus, it will be understood that the mounting end 112 is provided in certain embodiments to enable the umbrella assembly 100 to be conveniently mounted in place for use of the assembly 100.

The support pole 110 comprises a generally elongate rigid member which enables the canopy frame 102 to maintain the shade member 104 in an open or expanded configuration in a position spaced away from the mounting end 112 where the umbrella assembly 100 can be mounted in place. FIG. 1 illustrates one embodiment in which the support pole or member 110 is substantially straight or linear along the extent of the support pole 110. In other embodiments, the support pole or member 110 comprises both straight or linear portions, as well as curved portions. In yet other embodiments, the support pole or member 110 is curved substantially along an entire extent of the support pole or member. FIG. 1 also illustrates that one embodiment of the support pole or member 110 can be arranged in a substantially vertical orientation. In other embodiments, the support pole or member 110 can be arranged in an angled or diagonal orientation depending on the requirements of particular applications.

The canopy frame 102 preferably comprises relatively strong, lightweight materials having suitable durability and weather resistant properties for the particular application of the umbrella assembly 100. Suitable materials for the canopy frame 102 can include but are not limited to light gauge corrosion resistant steels, aluminum alloys, titanium alloys, wood, plastics, carbon fiber materials, and/or other relatively high strength weather resistant materials as are well known. Appropriate selection of materials for construction of the canopy frame 102 can be at least partially dictated in particular applications by the desired aesthetic properties of the umbrella assembly 100, including the canopy frame 102. For example, in certain applications, desirable aesthetic qualities of the umbrella assembly 100 may indicate the use of finished or unfinished wood as components of the canopy frame 102, although other components may offer certain advantages in strength, weight, cost, or other characteristics. Thus, it will be appreciated that the materials selected for construction of the umbrella assembly 100 can vary in different applications and the selection of an appropriate material will be readily apparent to one of ordinary skill considering the disclosure and illustration of the subject application and the requirements of a particular application.

FIG. 1 shows that the canopy frame 102 can extend generally radially outward from a central axis of the umbrella assembly 100. In one implementation, the central axis is defined by a major or longitudinal axis of the support pole or member 110. The canopy frame 102 is articulated such that the canopy frame can extend into the open or expanded configuration 106 as illustrated in FIG. 1 and can further be collapsed or closed to the configuration 108, for example, as illustrated in FIG. 3.

FIGS. 1-4 illustrate that the umbrella assembly 100 includes an actuator assembly or 140. A user can open and close the umbrella assembly 100 and the canopy frame 102 in this embodiment by actuating the actuator assembly 140. The actuating assembly 140 enables a user to apply force by hand to release the canopy frame 102 from a secured or stowed configuration. When the canopy frame 102 is released, the umbrella assembly 100 can be opened or closed.

The actuator assembly 140 is of a simple mechanical structure, yet is able to open and close the umbrella assembly 100 with a relatively low force. This is a significant advantage for smaller and weaker users. The actuator assembly 140 avoids complex mechanisms and thus reduces susceptibility to foreign material contamination and corrosion. The actuator assembly 140 also offers aesthetic advantages which will be described in greater detail along with the operational advantages of the actuator assembly 140 following a more detailed description of the component structure of the assembly 140.

Figure 4:
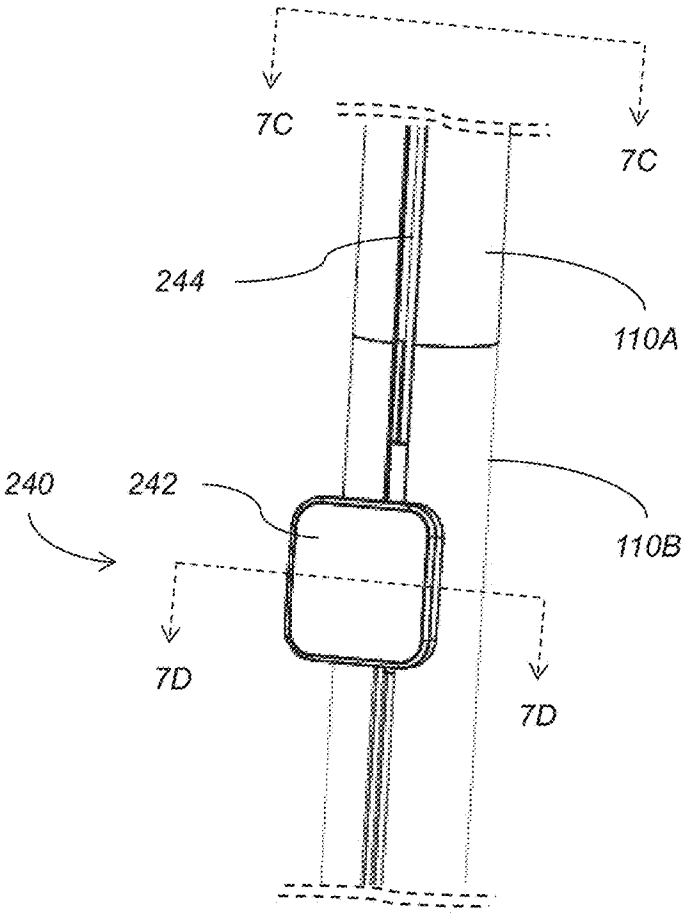
FIG. 4 is a perspective view of one embodiment of an actuator handle of a set up assembly of an umbrella.
Figure 5:
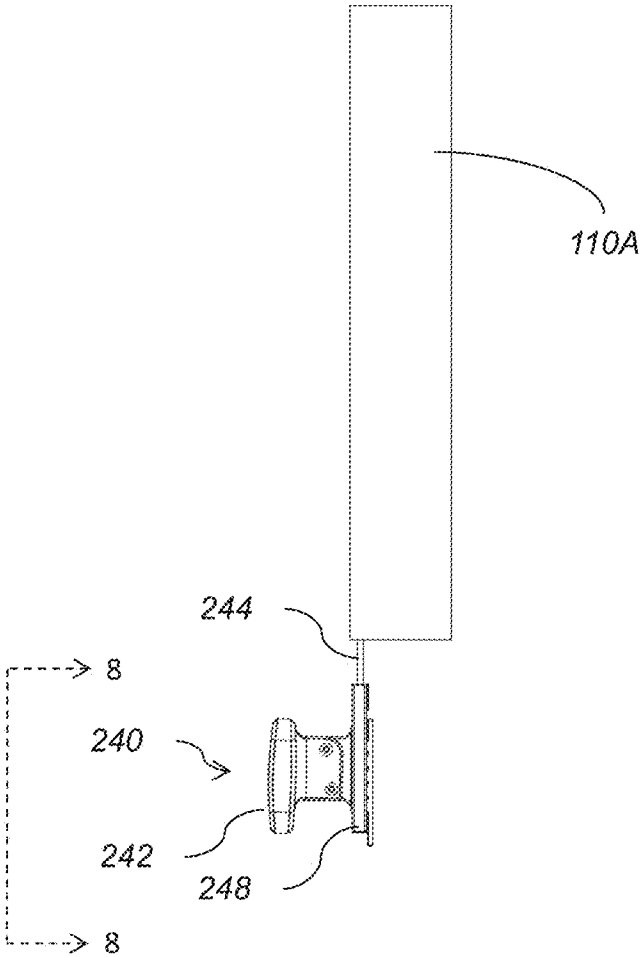
FIGS. 5 and 6 are side and front views of a set up assembly according to an embodiment of this application.
Figure 6:
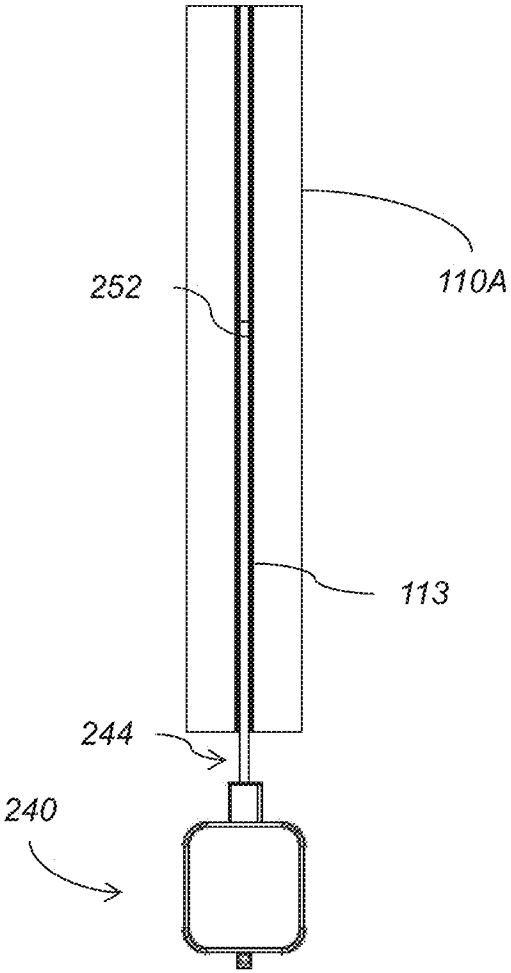

FIGS. 2-4 illustrate the actuator assembly 140 in more detail. The actuator assembly 140 enables movement of a handle thereof and locking of a locking device at selected position of the umbrella 100, as discussed below.

FIG. 3 illustrates in side section view one embodiment of the canopy frame 102 in greater detail. As previously noted, in one embodiment, the canopy frame 102 is coupled with the support 110 whereby the canopy frame is extended or elevated. The canopy frame 102 can be raised or lowered via hand manipulation of the actuator assembly 140. In this embodiment, an upper portion 114 is provided that is vertically translatable relative to a lower portion of the support pole 110. In one embodiment, the upper portion 114 is a pole that fits within the lower portion of the support pole 110 in a male-female arrangement which inhibits transverse translation of the upper portion 114 relative to the lower portion of the support pole 110. The configuration permits longitudinal movement, e.g., sliding along a major or longitudinal axis of the umbrella 100. In one embodiment, the lower portion of the support pole 110, together with the upper portion 114, define an engagement region 118 within which the two portions of the pole 110 are engaged. FIGS. 2 and 3 show the engagement region 118 is substantially straight or linear in some embodiments. In other embodiments, the support pole 110 and upper pole 114 can have a cooperating curvature such that a curved engagement region 118 still permits longitudinal sliding between the two portions of the poles 110.

Figure 7A:
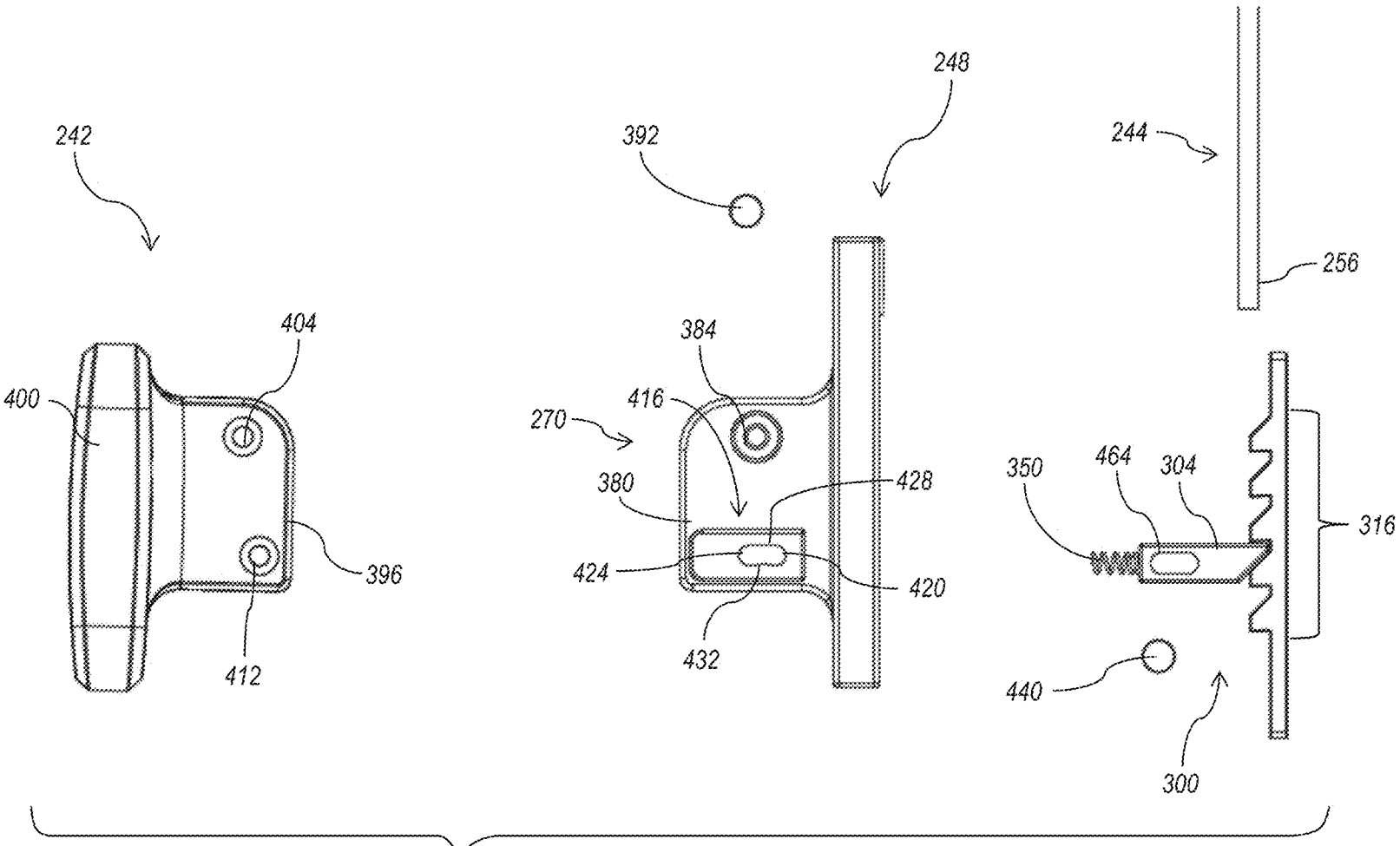
FIGS. 7A and 7B are exploded views of the embodiment of the set up assembly of FIGS. 4-6.
Figure 7B:
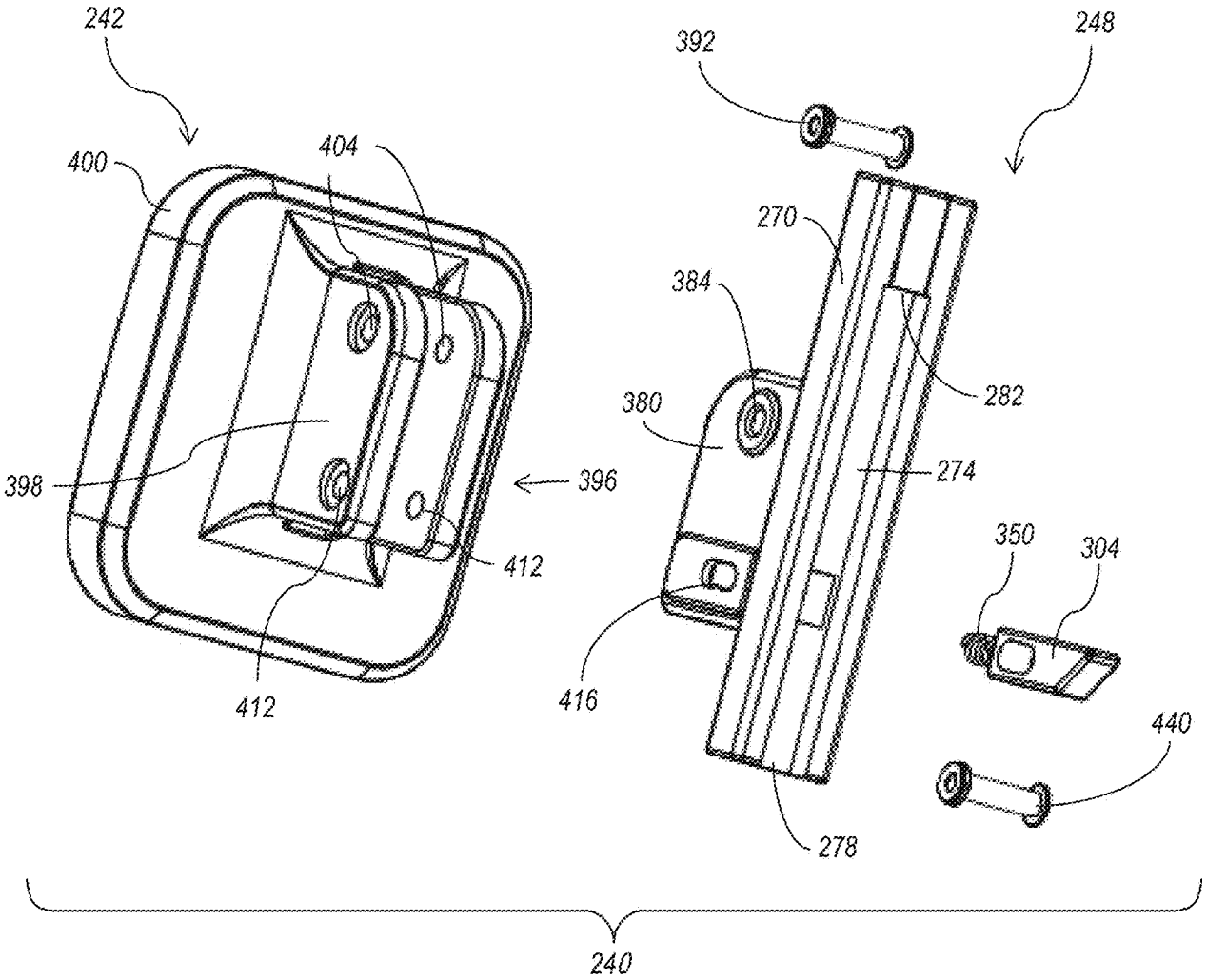
Figure 7C:
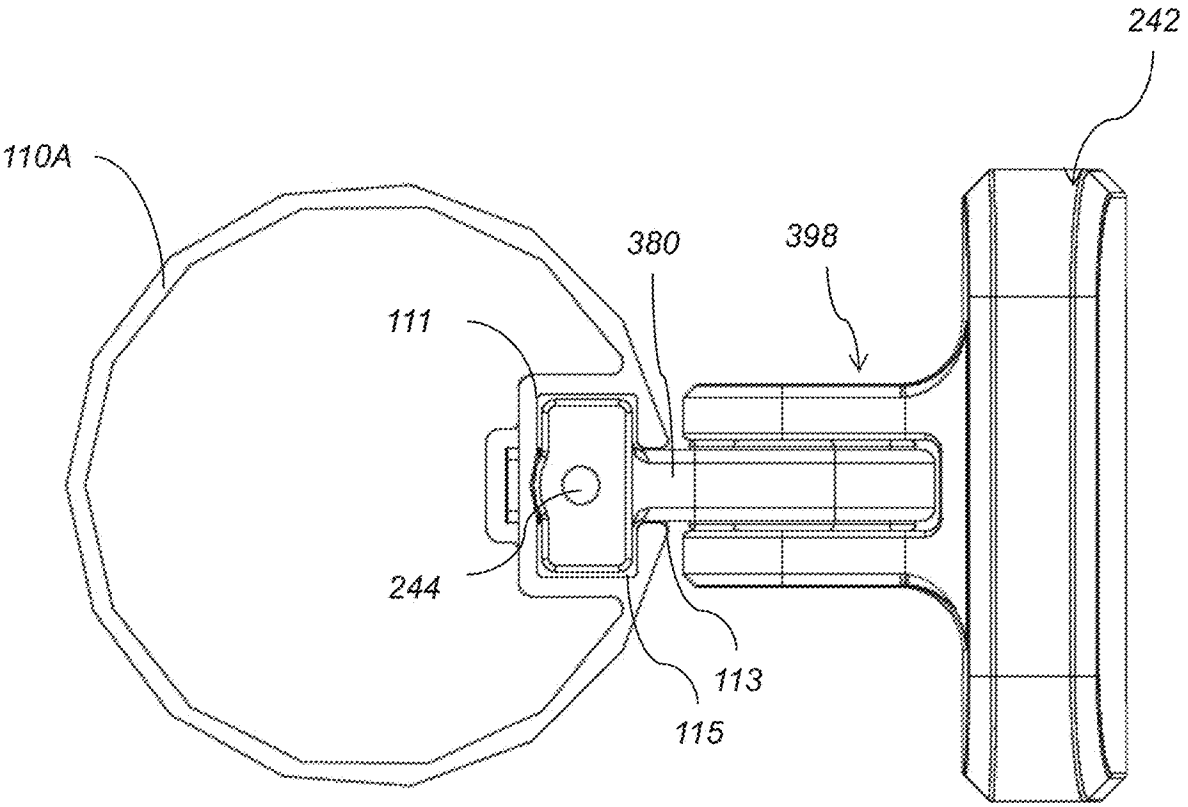
FIG. 7C is a top view of the embodiment of the set up assembly of FIGS. 4-6 taken from the direction 7C-7C in FIG. 4.
Figure 7D:
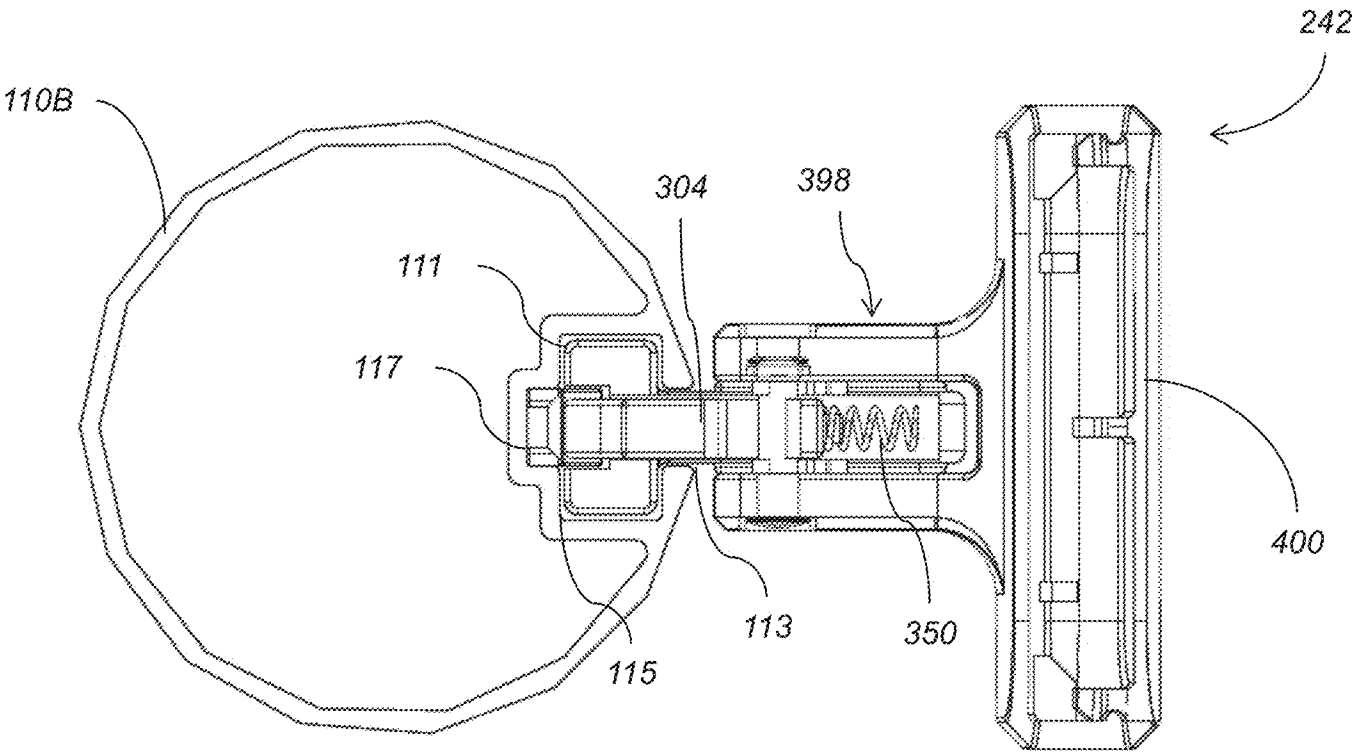
FIG. 7D is a cross-sectional view of the embodiment of the set up assembly of FIGS. 4-6 taken through section plane 7D-7D in FIG. 4.
Figure 8:
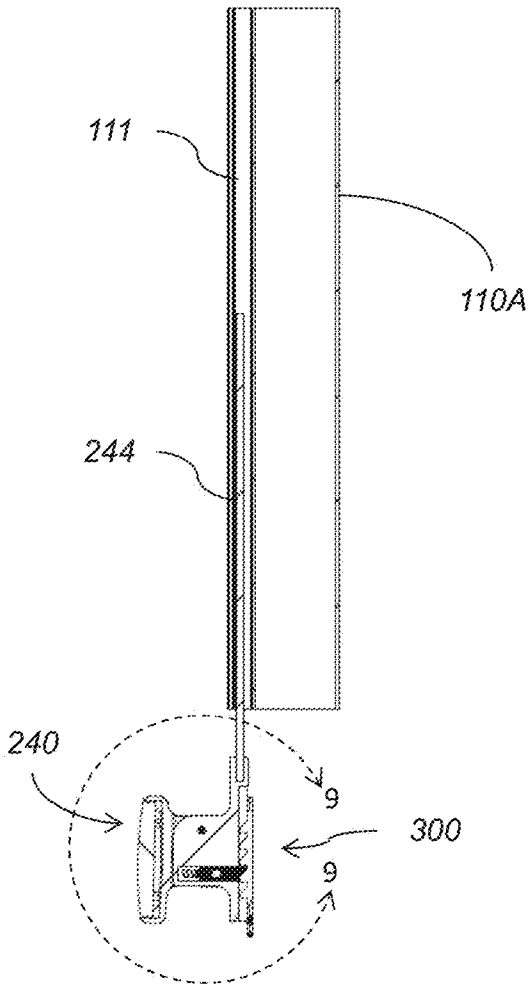
FIG. 8 is a cross-sectional view taken at the section plane 8-8 shown in FIG. 5.

If the support pole 110 has distinct segments as illustrated in FIGS. 7C and 7D, the upper portion 114 can be a third portion that is received within the upper segment of the pole 110.

The canopy frame 102 further comprises a first hub 130, a second hub 132, and a third hub 124. The first hub 130 is attached to the upper portion 114 of the pole 110 in one embodiment, e.g., adjacent an upper end thereof. In one embodiment, the first hub 130 is mounted to the upper portion 114 of the pole 110 such that both translation and rotation of the first hub 130 are restrained relative to the upper pole 114. In another embodiment, at least one of rotation and translation of the first hub 130 relative to the upper pole 114 is restrained. In another embodiment, one of rotation and translation of the first hub 130 relative to the upper portion 114 of the pole 110 is restrained. In some arrangements, the first hub 130 is an upper hub that is coupled with a plurality of ribs in one embodiment.

The second hub 132 is coupled with, e.g., mounted to, an upper end of the lower portion of the support pole 110. The upper end of the lower portion of the support pole 110 is an end opposite of the mounting end 112. In this embodiment, the second hub 132 also is attached to restrain at least one of, e.g., both of, translation and rotation of the second hub 132 relative to the lower portion of the support pole 110. In one embodiment, the second hub 132 is a middle hub that is coupled with a portion of a pole, which can be the lower portion of the support pole 110. In one embodiment, the second hub 132 is a middle hub that is coupled with a top portion of the upper segment 110B of the support pole 110.

As discussed further below, the third hub 134 is coupled with one or more ribs of the canopy support structure 120. The third hub 134 also can be coupled with the support pole 110. As discussed further below, the third hub 134 can be arranged to slide along a portion of the support pole 110 in one embodiment. The third hub 134 can also be located at a position intermediate the second hub 132 and the mounting end 112 of the lower portion of the support pole 110. Thus, in one embodiment, the first hub 130 is arranged at one end of the umbrella assembly 100 opposite from the mounting end 112. The second hub 132 and third hub 134 are positioned intermediate the first hub 130 and the mounting end 112, with the second hub 132 being further interposed between the first hub 130 and the third hub 134.

The third hub 134 can be coupled with the lower portion of the support pole 110, e.g., with the upper segment 110B, such that rotation of the third hub 134 relative to the support pole 110 is restrained. Preferably, the coupling of the third hub 134 with the support pole 110 permits vertical movement, e.g., sliding along the longitudinal axis of the support pole 110. This arrangement restrains horizontal or transverse translation of the third hub 134 relative to the support pole 110. The third hub 134 is attached to the support pole 110 in a manner which allows controlled translation of the third hub 134 longitudinally or along a major axis of the support pole 110.

As previously mentioned, in one embodiment, the umbrella assembly 100 can be opened and/or closed via manipulation of the actuator assembly 140. In one embodiment, the actuator assembly 140 is configured to be slideably interconnected with the support pole or member 110. The actuator assembly 140 is further interconnected with the first hub 130 via an actuating member 144, which can be a rod. In one arrangement, the actuating member 144 comprises a portion of the upper portion 114 of the support pole 110. In this embodiment, longitudinal force or force applied along the major axis of the support pole 110 to the actuating assembly 140 is communicated via the actuating member 144 to the first hub 130. A longitudinal force applied to the actuating assembly 140 in a direction away from the first hub 130 along the support pole 110 or generally in a direction towards the mounting end 112, as indicated by the downwardly pointing arrow in FIG. 2, applies a downward force to the first hub 130 inducing the first hub 130 to follow the motion of the actuating assembly 140. An opposite force applied to the actuating assembly 140 applies a compressive force to the actuating member 144, which transfers the force to the first hub 130 to induce the canopy assembly 120 to collapse or close as illustrated in FIG. 3.

The actuating member 144 can comprise a generally elongate rigid or semi-rigid member interconnecting a handle of the actuating assembly 140 and the first hub 130. However, in other embodiments the actuating member 144 acts in tension and a cable is used to connect the actuating assembly 140 to the first hub 130. As in certain embodiments, the actuator assembly 140 and actuating member 144 connected to the first hub 130 operate in tension. These embodiments avoid the bending and binding of rigid or semi-rigid members of structures in which an elongate member is subjected to compression forces. Such mechanisms employing compressive forces also typically preclude the utilization of cables, ropes, and chains for conveying the entire opening and/or closing force as these are not well suited for effectively transferring a compression force.

A further advantage of certain embodiments of the umbrella assembly 100 and the canopy frame 102 thereof are that gravity and the weight of the umbrella assembly 100 can assist in at least one of the opening and closing the umbrella assembly 100. More particularly, when embodiments of the umbrella assembly 100 are arranged in a generally vertical orientation, e.g., when the support pole 110 is arranged generally vertically, gravitational forces act upon the mass of the components of the umbrella assembly 100, urging these components downward in the absence of a locking device. For example, as illustrated in FIG. 3, a limited restraining force can be applied along the longitudinal extent of the support pole 110 to control the closing of the umbrella assembly 100 with gravity assisting the collapse of the canopy frame 102. In use, a force less than the weight of the user may be applied to the actuating assembly 140 in a generally downward direction to induce the opening or erection of the umbrella assembly 100. Preferably, raising or opening of the umbrella assembly 100 requires relatively little muscular exertion as the user can simply use a portion of their body weight to apply a generally downward force to the actuator assembly 140, e.g., by leaning on the actuator assembly. This facilitates use of a relatively large umbrella assembly 100 by those of relatively small stature and/or limited strength or by the physically impaired.

Further advantages to the opening and closing of the umbrella assembly 100 are provided by the arrangement of the canopy frame 102. More particularly, in one embodiment, the canopy frame 102 comprises a first rib 122 that is interconnected with a corresponding second rib 124. The first rib 122 has a first end 123A coupled with the first hub 130. The second rib 124 has a first end 125A coupled with the third hub 134. The third hub 134 is the lower hub in the illustrated embodiment as discussed above. The first rib 122 can be one of a plurality of ribs coupled with the upper hub 130. The second rib 124 can be one of a plurality of ribs coupled with the lower hub 134. The canopy frame 102 can include a third rib 126. The third rib 126 can have a first end 127A coupled with the second hub 132 and a second end 127B coupled with the second rib 124.

The first rib 122 can be a member of a plurality of ribs connected to the hub 130. The second rib 124 can be a member of a plurality of ribs coupled with the lower hub 134. The third rib 126 can be a member of a plurality of ribs coupled with the middle hub 132. The second and third ribs 124, 126 extend generally radially outward from a centerline or central axis of the umbrella assembly 100, e.g., of the canopy frame 102. The ribs 122 are positioned generally at an upper extent of the canopy frame 102 to support attachment points for the shade member 104. The ribs 122 extend substantially the radial extent or to the peripheral edge of the shade member 104 in one embodiment. The first ends 123 of the mounting ribs 122 can be pivotably connected or nested in the first hub 130. The second ends 125B of the second ribs 124 can be pivotably connected along intermediate points to the mounting ribs 122. The first ends 125A of the ribs 124 can be pivotably connected or nested in the third hub 134. Second ends 127B of the third ribs 126 can be pivotably connected to intermediate points of the second ribs 124 with first ends 127A of the third ribs 126 being pivotably connected or nested with the second hub 132 in some embodiments.

Thus, the first hub 130 can be controllably moved longitudinally relative to the second hub 132 via manipulation of the actuator assembly 140 and the actuating member 144. The third hub 134 is free to slide longitudinally relative to the second hub 132, e.g., along the support pole 110, in one embodiment. The mounting ribs 122 and the first and second erection members 124, 126 are pivotably connected with each other and with the first, second, and third hubs 130, 132, 134 to define an articulating mechanism. Moving the first and third hubs 130, 134 relative to the second hub 132 will close or collapse, or open or raise respectively the canopy support structure 120 and the attached canopy 104.

Appropriate selection of the relative lengths of the first ribs 122, the second ribs 124, and the third ribs 126 as well as the location of corresponding intermediate points of the mounting ribs 122 and of the second rib 124 (to which the second rib 124 and third ribs 126 are respectively connected), provide mechanical advantage. Providing mechanical advantage can further reduce the force required to be applied to the actuator assembly 140 to raise or lower the umbrella assembly 100. As previously noted, in some embodiments, gravity can assist in at least one of opening and closing of an umbrella, e.g., the umbrella assembly 100. In other embodiments, the umbrella assembly 100 defines a substantially balanced or weight neutral configuration. For example, the relative weight, placement, and mechanical leverage ratios of the components of the umbrella assembly 100 can be arranged such that gravity induces the assembly 100 to open or to close. The umbrella assembly 100 can also be constructed such that weight loads are substantially balanced such that, absent an opening or closing applied force, the umbrella assembly 100 is balanced and not induced to either close or open.

In one embodiment, an umbrella assembly 100 of an approximate open height of one hundred and fifteen inches (approximately 292 centimeters) and having a canopy diameter of approximately thirteen feet (approximately 396 centimeters) can be readily opened or closed by an ordinary user (e.g., one of average strength). In one embodiment, the umbrella assembly 100 can have approximate closed height of one hundred and forty inches (approximately 356 centimeters). This is achieved in part by providing first ribs 122, second ribs 124, and third ribs 126 of a suitable configuration. For example, the length of the first ribs 122 is about eighty inches (about 203 centimeters) in one embodiment. The length of the second ribs 124 is about thirty-seven inches (about 94 centimeters) in one embodiment. The length of the third ribs 126 is sixteen inches (about 41 centimeters) in one embodiment. Each of the second 124 is attached to a corresponding rib 122 at about forty-four inches (about 112 centimeters) from the proximal end of the rib 122. Each of the third ribs 126 is attached to a corresponding second rib 124 at about twenty-one inches (about 53 centimeters) from the proximal end of the second rib 124.

Other size umbrellas can be constructed that can be easily opened by an ordinary user. For example, in one embodiment the ribs 122 are constructed with a length that is about equal to two times the length of the second ribs 124. In another embodiment, the first ribs 122 are constructed with a length that is more than two times the length of the second ribs 124. In another embodiment, the second ribs 124 are constructed with a length that is about equal to two times the length of the third ribs 126. In one embodiment, the second ribs 124 are constructed with a length that is more than two times the length of the third ribs 126. In another embodiment, the ribs 122 are constructed with a length that is about equal to four times the length of the third ribs 126. In another embodiment, the ribs 122 are constructed with a length that is more than four times the length of the third ribs 126.

Other arrangements also facilitate umbrella operation by an ordinary user. For example, in one embodiment the ribs 122 are connected to the second ribs 124 by a pivoting joint that is located a distance more than half the length of the ribs 122 from the first ends 123A of the ribs 122. In another embodiment, the second ribs 124 are connected to the third ribs 126 by a pivoting joint that is located a distance more than half the length of the second ribs 124 from the first ends 125A of the second ribs 124. In another embodiment, the ribs 122 are connected to the second ribs 124 by a pivoting joint that is located closer to the second ends 123B of the ribs 122 than to the first ends 123A thereof and the second ribs 124 are connected to the third ribs 126 by a pivoting joint that also is located closer to the distal ends 125B of the erection member 124 that to the proximal ends 125A thereof.

FIGS. 4-13 show additional components and details of another embodiment of an actuator assembly 240. The actuator assembly 240 is one example of a set up assembly as discussed above. The actuator assembly 240 is advantageous in a number of ways, such as by enabling the open configuration to be secured without a friction plate or screw-actuated mechanisms. This allows a secure open configuration to be reached by a simple movement of a handle 242 of the actuator assembly 240.

Figure 9:
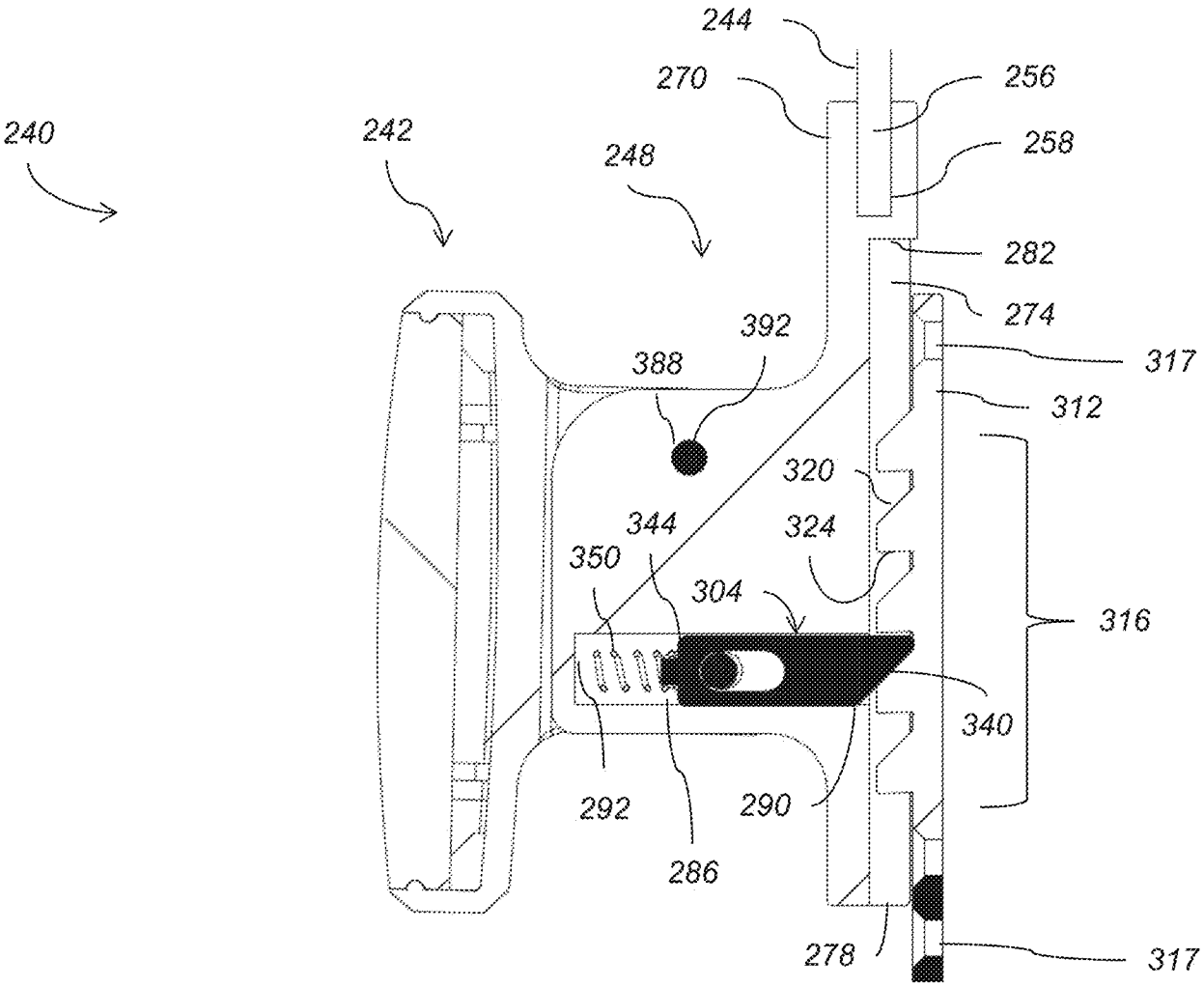
FIG. 9 is a detail cross-sectional view taken at detail area 9-9 shown in FIG. 8.

In one embodiment, the actuator assembly 240 has a rod 244 disposed along the support pole 110 and a traveler 248. The rod 244 has a first end 252 coupled with the upper hub or the first hub 130. In one embodiment, the first end 252 is spaced a short distance from a second end 256 of the rod 244. The rod 244 has an elongate body that extends between the first end and the second end 252, 256. In one embodiment the elongate body is not long enough to directly couple with the hub 130. Instead, the first end 252 is coupled with an intervening member (not shown) that extends from the second end 256 to the hub 130. In other embodiments, the elongate body of the rod 244 is longer such that the first end 252 is located at and directly coupled with the hub 130. The second end 256 of the rod 244 can be coupled with or directly connected to the traveler 248. FIG. 9 shows that the second end 256 can be received in a recess 258 of the traveler 248.

In one embodiment, the rod 244 is disposed in a channel 111 of the support pole 110. FIG. 7C shows that the channel 111 can be C-shaped with a narrow opening 113 on one side. The channel 111 allows the rod 244 to be housed in an enclosed space 115 inside the outer periphery of the support pole 110. The enclosed space 115 can also be sufficient to retain a portion of a locking device 300 discussed further below. The opening 113 allows a portion of the traveler 248 to extend from inside the channel 111 to outside the support pole 110. FIG. 7D shows that the channel 111 can have a different configuration in a lower portion of the support pole 110. The lower portion can correspond to the location of a locking device 300 discussed further below. In the lower portion, the channel 111 has a recess 117 disposed therein. The recess 117 is configured to have a portion of the locking device 300 mounted therein. The recess 117 can be located on a wall of the channel 111 opposite the opening 113. The recess 117 can have a depth about equal to the thickness of the wall surrounding the channel 111.

The traveler 248 can include a sliding block 270. The sliding block 270 is configured to be disposed in the channel 111 of the support pole 110. For example, in one embodiment the sliding block 270 comprises an elongate shape that matches the shape of the enclosed space 115 but is smaller by an amount sufficient to allow for free movement, e.g., sliding movement along the walls of the channel 111. In certain embodiments, structures are provided to reduce the friction between the sliding block 270 and the channel 111. For example, the channel 111 can comprise, e.g., be formed by or lined with a low friction polymer. In some embodiments, wheels or rollers can be provided between the sliding block 270 and the walls of the channel 111.

The sliding block 270 can have a longitudinal recess 274 disposed therein. The longitudinal recess 274 can be disposed along a longitudinal axis of the sliding block 270. The longitudinal recess 274 can have an open lower end 278 and an enclosed upper end 282. The open end 278 is configured to be slideably advanced along or over a portion of the locking device 300 as discussed further below. In one embodiment, the recess 274 is configured to have disposed herein a portion of the locking device 300 between the closed end 282 and the open ends 278. A portion of the locking device 300 can be advanced across the longitudinal recess 274 in some embodiments.

FIG. 9 shows that in one embodiment the sliding block 270 includes a transverse recess 286. The recess 286 is disposed generally transverse to the longitudinal channel 274. The transverse recess 286 includes a first end 290 in the channel 111 of the support pole 110 and a second end 292. The second end 292 can be disposed outside the channel 111 in some embodiments. The transverse recess 286 is configured to slideably receive a locking pin 304 of the locking device 300 as discussed further below. The locking pin 304 is retractable within the transverse recess 286. In some embodiments, the locking pin 304 is moveable generally across the longitudinal recess 274 between a number of positions as discussed further below.

The locking device 300 includes a portion 312 coupled with the support pole 110 and a portion disposed on or in the actuator assembly 240. In one embodiment, the portion 312 includes a plurality of spaced apart ratchet features 316 positioned on a plate member 318. The plate member 318 can have one or more apertures 317 formed therein for receiving fasteners to enable the plate member to be secured to a surface inside the channel 111 of the support pole 110. In one embodiment, the ratchet features 316 can configured with a ramped side 320 that faces upward and an opposing surface 324 that faces away from the ramped side 320. The opposing surface 324 can be a flat surface that faces downward.

The locking pin 304 includes an elongate rigid body with a first end 340 and a second end 344. The first end 340 is disposed adjacent to the first end 290 of the recess 286. The second end 344 is disposed adjacent to the second end 292 of the recess 286. The locking pin 304 is configured to move, e.g., to slide, in the recess 286. In one embodiment, the locking pin 304 is configured to be biased in a direction away from the second end 292, e.g., in a direction toward the ratchet features 316 when the actuator assembly 240 is disposed over the ratchet features. For example, a coil spring 350 can be disposed between the second end 292 of the recess 286 and the second end 344 of the locking pin 304. The coil spring 350 is compressed to store strain energy when the locking pin 304 moves toward the second end 292 of the recess 286. The coil spring 350 releases the stored strain energy when the locking pin 304 moves away from the second end 292 of the recess 286, e.g., into engagement with the ratchet features 316.

FIGS. 10-13 shows additional features of the actuator assembly 240 and the locking device 300, including how these components function together to alter the configuration and/or position of components of the umbrella assembly 100. In one embodiment, the actuator assembly 240 is pivotably coupled to the traveler 248. For example, the traveler 248 can have a lateral or radial flange 380 (see FIG. 7C) that extends away from the sliding block 270. The flange 380 can have a first aperture 388 formed therein configured to receive an axle or pin 392. The pin 392 can be configured to facilitate rotation of the handle 242. For example, the handle 242 can have a first end 396 that has U-shaped configuration or portion 398 and a second end 400 that is enlarged and ergonomically formed for grasping by the user. The first end 396 can have a plurality of apertures 404 formed through the U-shaped portion 398. For example, one aperture 404 can be formed on each side of the U-shaped portion 398 across a space formed within and partially surrounded by the U-shaped portion 398. The U-shaped portion 398 can be formed such that the space is large enough to receive the radial flange 380 such that movement of the handle 242 relative to the flange 380 does not create excessive friction or undue wear. The U-shaped portion 398 can be formed such that the apertures 404 are aligned with the aperture 384 and the pin 392 can be passed through the apertures 404 and the aperture 384. The pin 392 facilitates rotational or pivotal movement of the handle 242 about an axis of rotation therethrough. The rotation of the handle 242 about the axis is one manner for disengaging the locking pin 304 from the ratchet features 316, as described further below.

Figure 10:
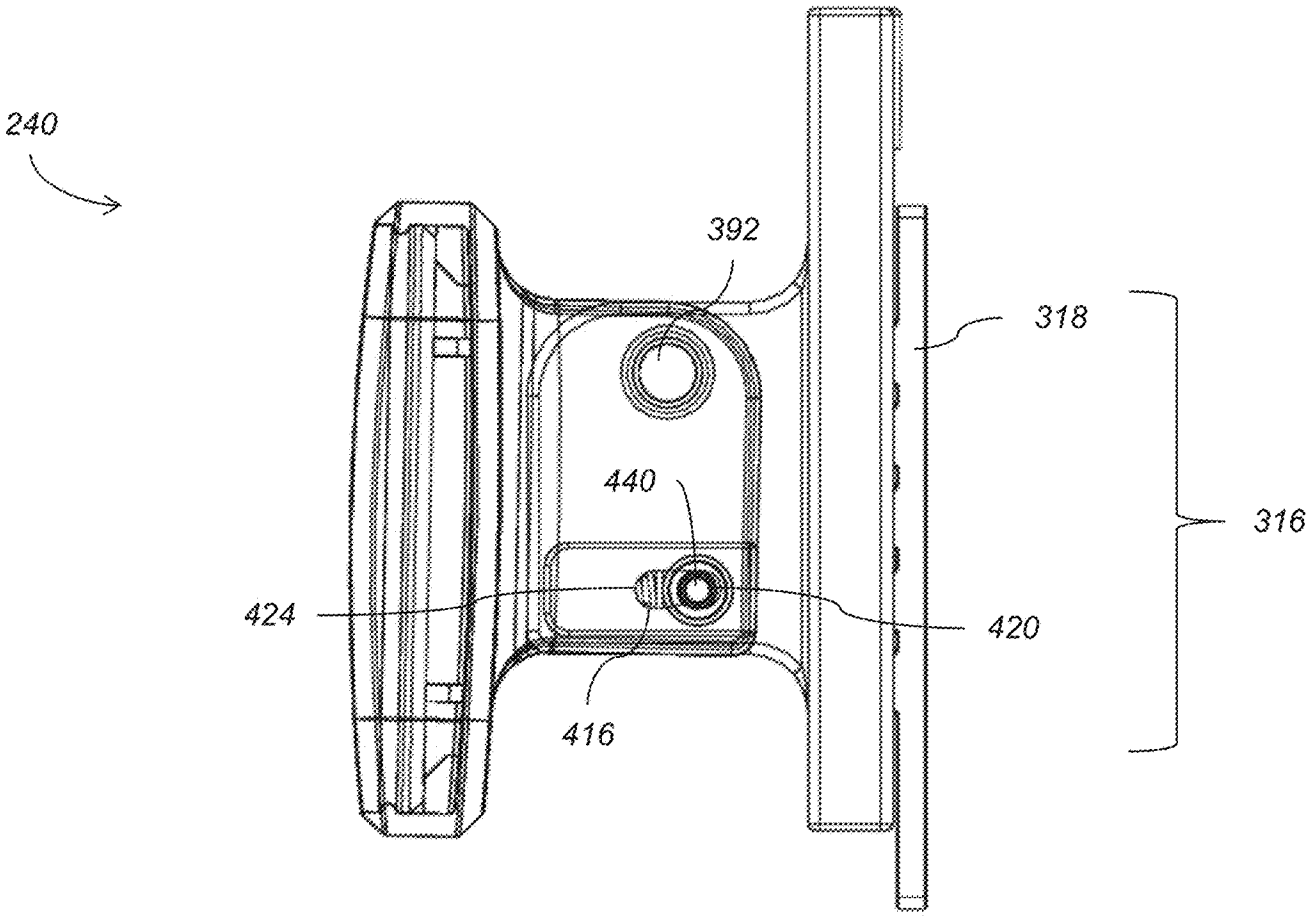
FIGS. 10-13 show various positions of one embodiment of an actuator assembly and one embodiment of a locking device for an umbrella.

The actuator assembly 240 and the locking device 300 are further configured to allow the vertical position of the traveler 248 to be selected. In one embodiment, the position can be selected by moving the actuator assembly 240 downward along the support pole 110. FIGS. 7A and 10 show that the radial flange 380 and the first end 396 of the handle 242 can have apertures configured to overlap each other in at least one position. FIGS. 7A and 7B show that the handle 242 can have a circular aperture 412 formed through opposing sides of the U-shaped portion 398. The radial flange 380 can have a slot 416 formed therein. The apertures 412 and the slot 416 can overlap as shown in FIG. 10.

FIGS. 7A and 7B show that the slot 416 can be configured to facilitate a movement of the actuator assembly 240 without requiring movement of the handle 242 in some embodiments. For example, the slot 416 can have an asymmetrical configuration in one embodiment. The slot 416 can be asymmetrical about a long dimension thereof. For example, the slot 416 can have two opposite ends 420, 424 that can have circular peripheries. The ends 420, 424 can be spaced apart by a distance greater than the diameter of either of the two ends 420, 424. In one embodiment, an upper periphery 428 of the slot 416 is substantially straight between the ends 420, 424. In one embodiment, a lower periphery 432 of the slot 416 is curved between the ends 420, 424. The lower periphery 432 can have a convex curve between the ends 420, 424. The convex curve can create a narrowing in the width of the slot 416 between the ends 420, 424. A narrowing between the ends 420, 424 of the slot 416 can enable an axle or pin 440 disposed through the apertures 412 and the slot 416 to move in a controlled fashion.

Figure 11:
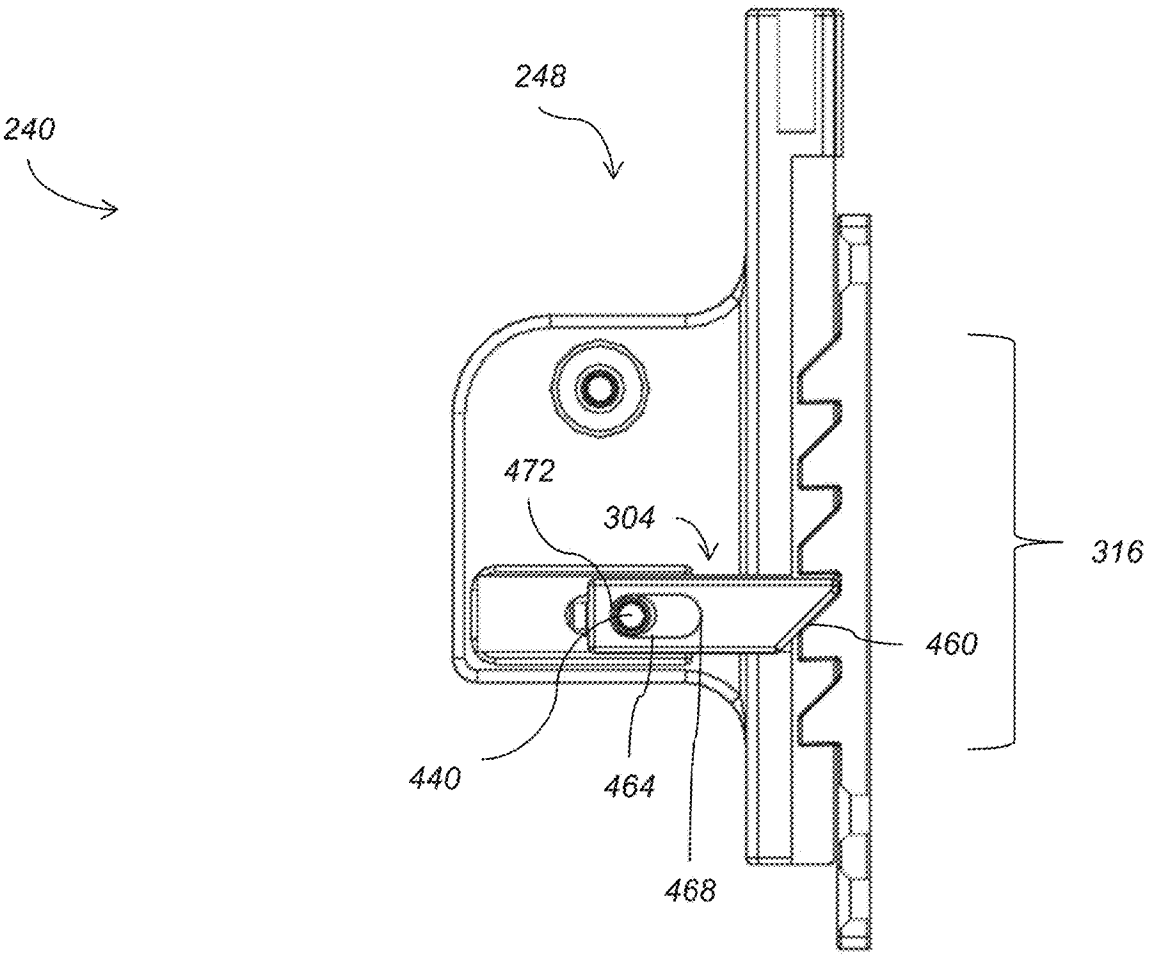

FIG. 10 shows a position of the actuator assembly 420 and the locking device 300 in which the handle 424 is disposed at an elevation corresponding to the ratchet features 316. The handle 424 is in a first position. The first position is a low profile position, with the handle 242 tucked in toward the support pole 100. FIG. 11 shows the traveler 248 and a portion of the locking device 300 in cross-section. The handle 242 is removed in this view for clarity. The locking pin 304 is disposed toward the ratchet features 316. The first end 340 is disposed between the opposing surface 340 of a first feature and a ramped surface of a second feature disposed below the first feature. As discussed above, the umbrella assembly 100 can be biased to move from an open position toward a closed position. So, the traveler 248 and the locking pin 304 will be generally urged upward by this configuration because the ratchet features 316 are positioned in the channel 111 on the support pole 110 at a position corresponding to an open canopy frame 102. The locking pin 304 can have a flat surface configured to abut the opposing surface 324 of the first ratchet feature in a manner prevent upward movement when the locking pin is in the position shown in FIGS. 9 and 11.

Figure 12:
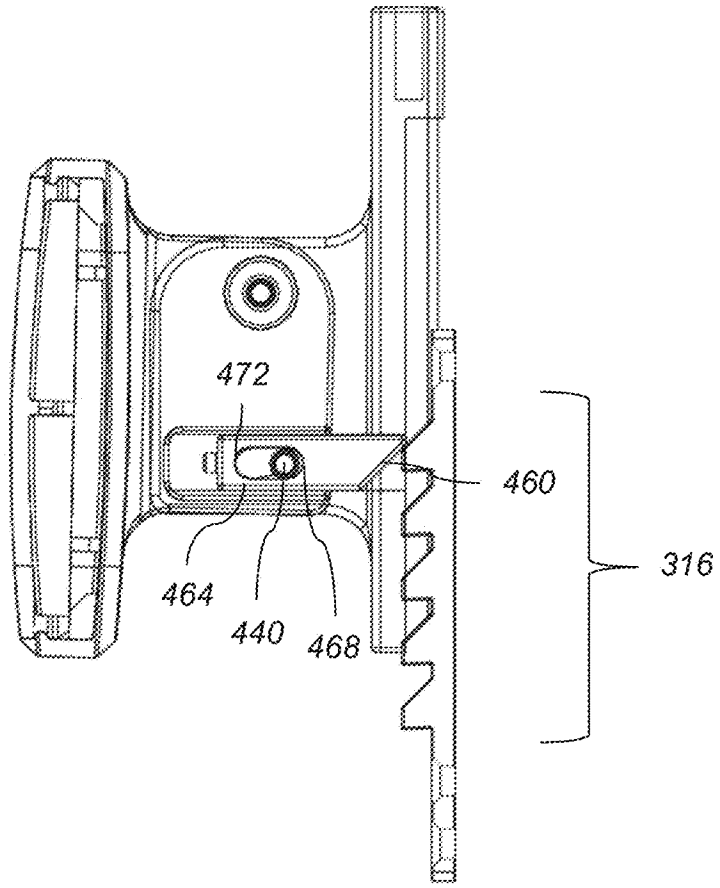

FIGS. 11 and 12 show how the locking pin 304 can move from a first position for locking to a second position for downward movement. The locking pin 304 has an angled face 460 at the first end 340. The angled face 460 can contact the ramped side 320 of each of the ratchet features 316. After the initial contact, further downward movement of the traveler 248 causes the locking ping 304 to move in the transverse recess 286. This movement continues until the locking pin 304 is sufficiently retracted and can pass from the ramped side 320 to the opposing side 324 of a single ratchet feature. Retraction of the locking pin is shown in FIG. 12. Further downward movement of the handle 242 once again causes retraction of the locking pin 304. The downward movement of the handle 242 along the ratchet features 316 can occur without requiring the handle 242 to rotate about the pin 392. This is in part because the locking pin 304 is configured to slide in the transverse channel 286 relative to the pin 440. Relative sliding can be provided by a slot 464 formed in the pin 304. The slot 464 can define a range of movement of the pin 304 within the transverse recess 286 that does not result in movement of the handle 242. The motion can be between a first end 268 and a second end 272 of the slot 264. For example, FIG. 11 shows the locking pin 304 in a position where the pin 440 is disposed at the second end 472 of the slot 464. In this position the locking pin 304 is fully inserted into the ratchet features 316, such that the locking device 300 is fully engaged. FIG. 12 shows the locking pin 304 in a position where the pin 440 is disposed at the first end 468 of the slot 464. In this position the locking pin 304 is retracted from the ratchet features 316, such that the locking device 300 is disengaged. In this position downward motion of the handle 242 relative to the ratchet features 316 is possible. As the locking pin 304 moves between the positions shown in FIGS. 11 and 12, no rotational movement of the handle 242 relative to the traveler 248 is required. Thus movement of the handle 242 along the ratchet features 316 can allow the user to achieve a range of open configurations as desired without requiring rotational motion or other complex simultaneous unlocking motion of the handle 242.

Figure 13:
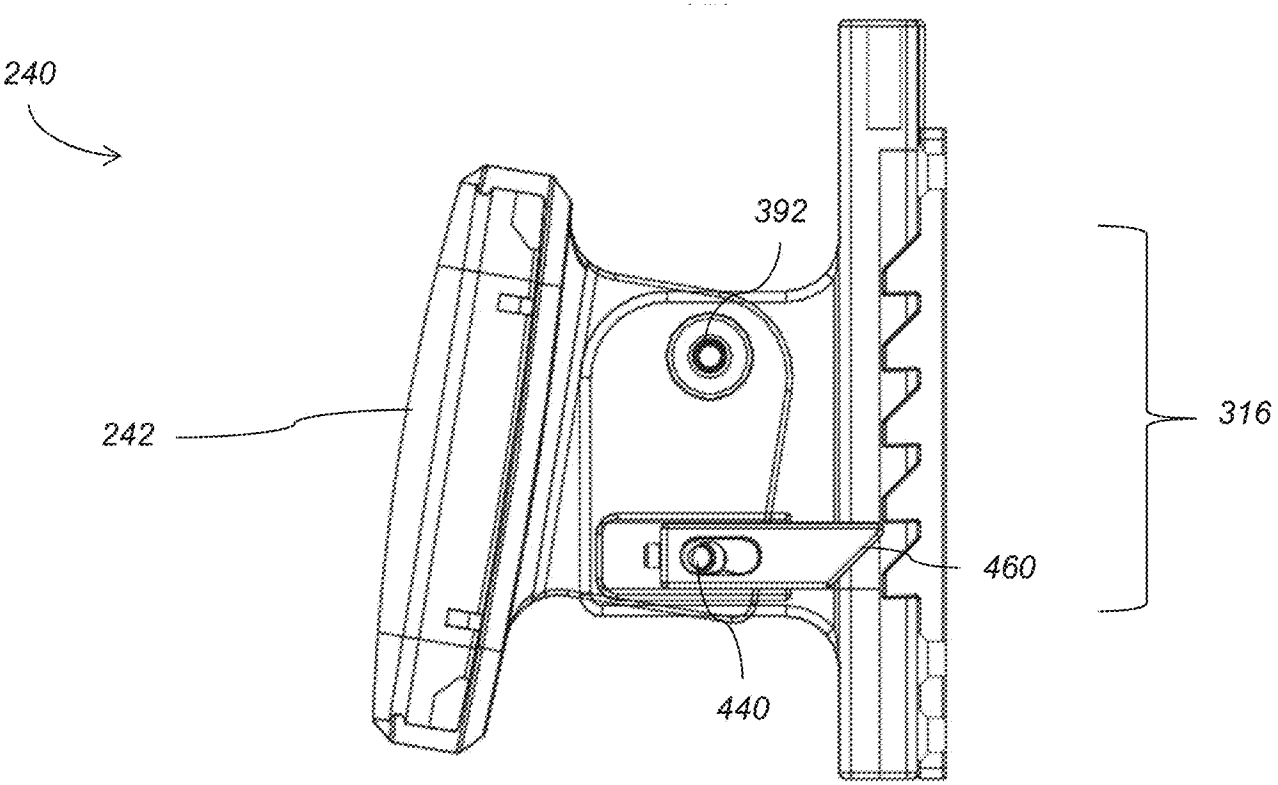

After any of the desired open configurations is achieved, the umbrella assembly 100 can be collapsed by a simple motion. FIG. 13 shows a state of the actuator assembly 240 and the locking device 300 that facilitates collapse of the umbrella assembly 100. The handle 242 can be rotated about the pin 392. This rotation moves the pin 440 toward the second end 472 of the slot 464. The position of the pin 440 in the slot 464 is shown most clearly in FIG. 11. Prior to such movement, however, the pin 440 must also be moved through the constriction in the slot 416. As the handle 424 is rotated the pin 440 moves from the first end 420 of the slot 416 toward the second end of the slot 416. A force exceeding the frictional forces of movement of the locking pin 304 in the slot 464 and in the slot 416 can be overcome to move the pin 440 through the constriction. Once the pin 440 is moved through the constriction in the slot 416, the pin can be disposed at the second end 472 of the slot 464 and at the second end 424 of the slot 416. In this position, the end of the locking pin 304 is fully disengaged from the ratchet features 316 as shown in FIG. 13. In this position, the actuator assembly 240 can be moved upward along the ratchet features 316. As discussed above, the umbrella assembly 100 can be configured such that movement upward along the ratchet features 316 can be at least in part due to the weight balance of the ribs. The angled position shown in FIG. 13 can be held by the configuration of the actuator assembly 240. For example, the force required to move the pin 440 through the constriction in the slot 416 can exceed a force that would urge the handle 242 toward the position of FIGS. 9-10 and 12. However, a user can easily push the handle 242 to move the pin 440 through the constriction in the slot 416 from the position of FIG. 13 to the position of any of FIGS. 9-10 and 12.

Figure 14:
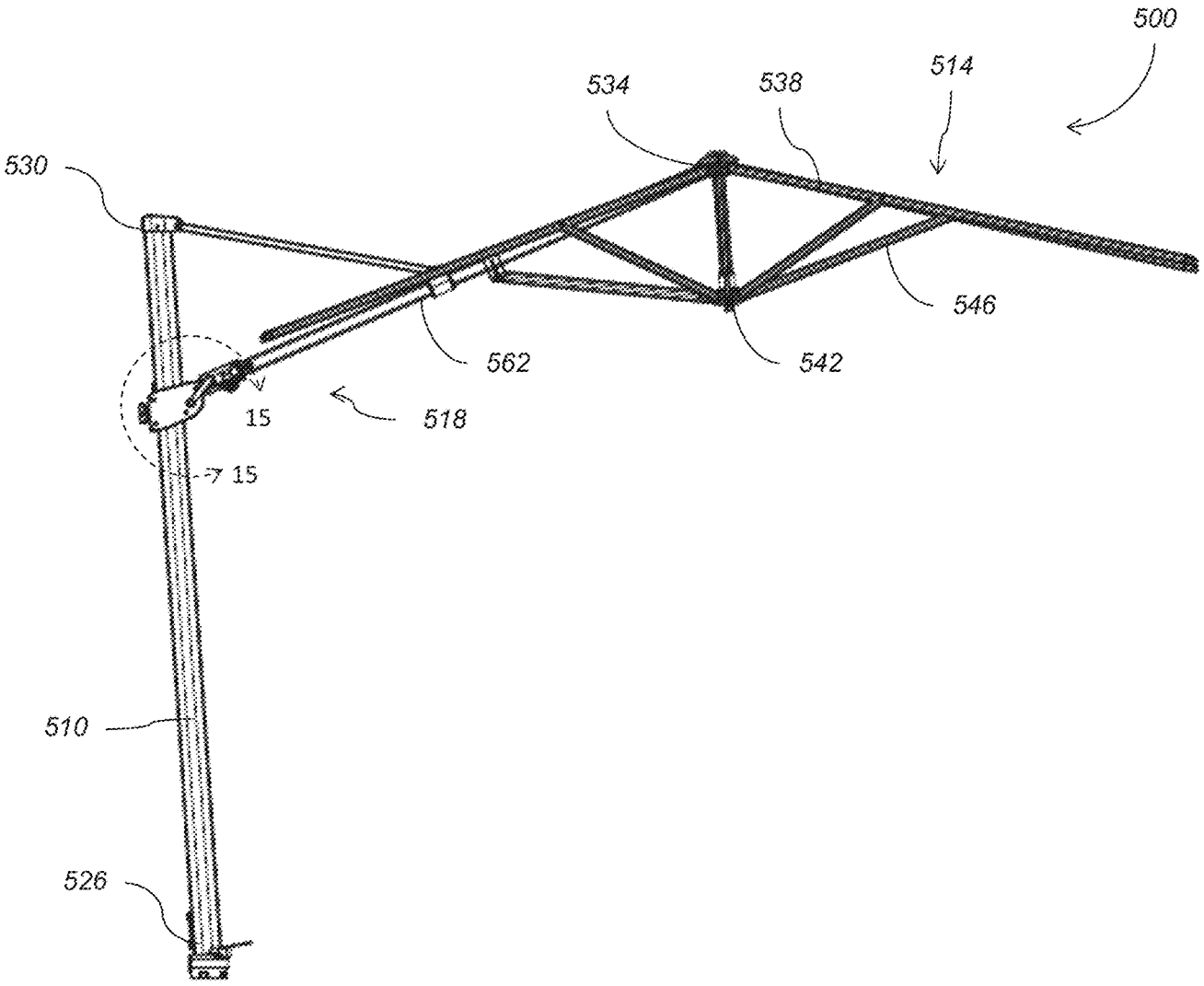
FIG. 14 shows a cantilever umbrella comprising a set up assembly according to any of the embodiments described herein.
Figure 15:
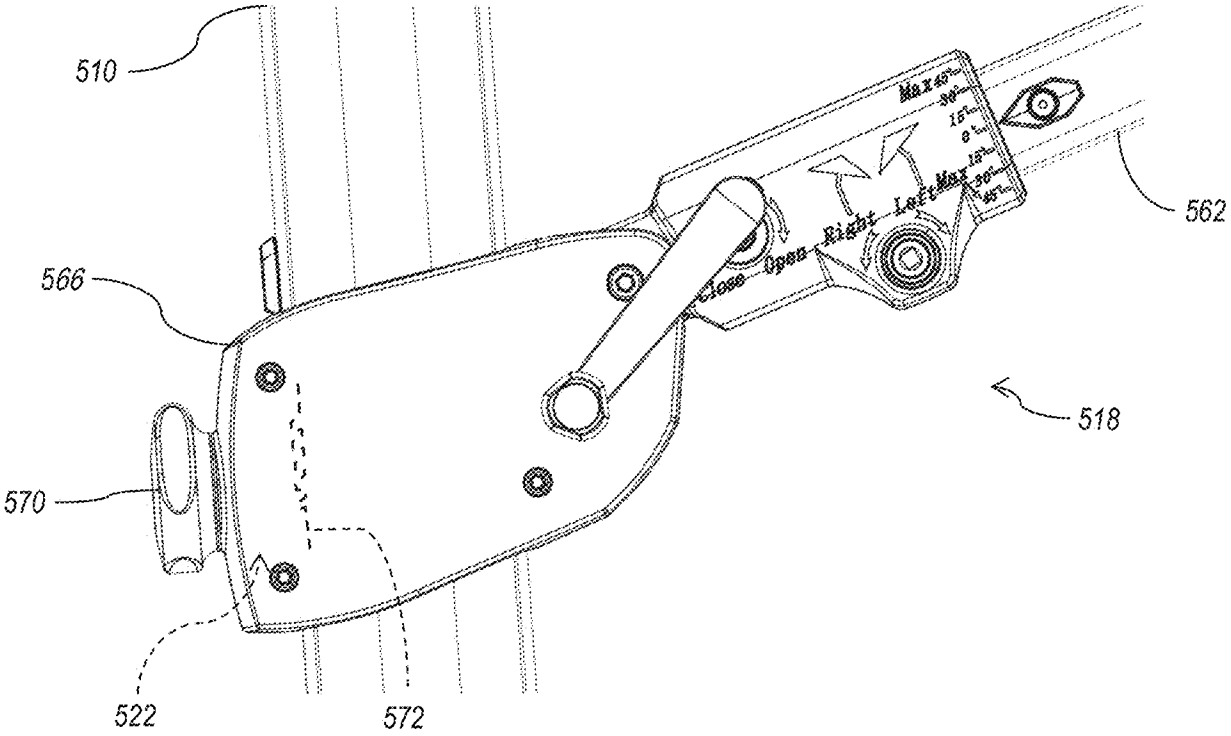
FIG. 15 is a detail view of the set up assembly shown in FIG. 14.

FIGS. 14 and 15 show another application for a set up assembly for a cantilever umbrella assembly 500. The umbrella assembly 500 is similar to the umbrella assembly 100 except as described differently below.

The umbrella 500 includes a support pole 510. The support pole 510 supports a canopy frame 514, a movement assembly 518, and a locking device 522. The support pole 510 has a lower portion that has a lower end 526 and an upper portion that has an upper end 530. The canopy frame 514 is coupled with the support pole 510. The canopy frame has an upper hub 534 coupled with a first end of a first rib 538 and a lower hub 542 coupled with a first end of a second rib 546. The second rib 546 has a second end coupled with the first rib 538.

The movement assembly 518 has a rod 562, a traveler 566 and a handle 570. The handle 566 can be similar in structure and function to the handle 242. The rod 562 has a first end coupled with the canopy frame and a second end moveable along the support pole 510. For example, the second end of the rod 562 can be coupled with the traveler 566. The handle 570 is pivotably coupled with the traveler 566, in a manner similar to the coupling of the handle 242 to the traveler 248. The locking device 522 can have a plurality of spaced apart recesses 572, which can be similar to the ratchet features 316, and a locking member, which can be similar to the locking pin 304. The locking member can be moveable relative to the traveler 566. A first end of locking member can have a first position disposed in any one of the plurality of recesses and a second position. The locking member can include a comb-like structure with a plurality of prongs that can simultaneously engage a plurality of recesses, e.g., ratchet features or channels. The second position of the locking member relative to the traveler 566 can be spaced away from all of the recesses. The locking pin can have a second end coupled with the handle 570.

The handle 570 can be configured to move relative to the traveler 566 to move the locking pin from the first position the second position to disengage the locking pin from the spaced apart recesses. In one embodiment, the handle 570 can operate in a manner similar to that of the handle 242. In another embodiment, the handle 570 rotates about an axis extending along a longitudinal axis of a stem thereof to induce retraction of the locking member. Such retraction can be by actuating pins in helical slots disposed about the pins.

As used herein, the relative terms "top" and "bottom" shall be defined from the perspective of an upright vertically supported umbrella assembly. Thus, top or upper refers the direction toward the exposed side of the shade member 104 when so supported, while bottom or lower refers to the direction toward the mounting end 121 or the end 526.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

The terms "approximately," "about," and "substantially" as used herein represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

Some embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Further, the actions of the disclosed processes and methods may be modified in any manner, including by reordering actions and/or inserting additional actions and/or deleting actions. Thus, it is intended that the scope of at least some of the present inventions herein disclosed should not be limited by the particular disclosed embodiments described above. The limitations in the claims are to be interpreted broadly based on the language employed in the claims and not limited to the examples described in the present specification or during the prosecution of the application, which examples are to be construed as non-exclusive.

What is claimed is:

1. An umbrella, comprising:

a support pole comprising a lower portion having a lower end and an upper portion having an upper end a canopy frame comprising:

a first rib;

an upper hub coupled with a first end of the first rib;

a second rib;

a lower hub coupled with a first end of the second rib, the second rib having a second end coupled with the first rib; and an actuator assembly comprising:

a rod disposed along the support pole and having a first end coupled with the upper hub and a second end disposed below from the upper hub;

a traveler coupled with the second end of the rod; and a handle pivotably coupled with the traveler;

a locking device comprising:

a plurality of spaced apart ratchet features;

a locking pin moveable relative to the traveler, a first end of locking pin having a first position disposed between adjacent ratchet features and a second position spaced away from the ratchet features, the locking pin having a second end coupled with the handle;

wherein the handle is configured to pivot relative to the traveler to move the locking pin from the first position the second position to disengage the pin from the ratchet features.

2. The umbrella of claim 1, wherein the traveler comprises a sliding block disposed in a channel of the support pole and a transverse recess having a first end in the channel of the support pole and a second end outside the channel, the locking pin being retractable within the transverse recess.

3. The umbrella of claim 1, wherein the traveler comprises a sliding block disposed in a channel of the support pole and a longitudinal recess having an open lower end configured to be slideably advanced over ratchet features and a second closed end to be disposed on a top portion of the ratchet features.

4. The umbrella of claim 1, wherein a first axle is provided between an upper portion of the handle and the traveler to permit rotational movement about an axis disposed through the first axle and a second axle is provided adjacent to a lower portion of the handle and the traveler to permit translation of the second axle in the traveler, the second axle also being coupled with the second end of the locking pin.

5. The umbrella of claim 1, wherein the locking pin comprises a first slot adjacent to the second end thereof and the traveler comprises a second slot disposed laterally of the first slot, the first slot allowing the locking pin to move between the first and second position without movement of the handle.

6. The umbrella of claim 1, wherein the traveler comprises a slot through which an axle couples the handle to the locking pin, whereby movement of the handle shift the locking pin from the first position to the second position.

7. The umbrella of claim 1, wherein a resilient member urges the locking pin toward the first position and away from the second position in the absence of an opposing force.

8. The umbrella of claim 1, wherein an upper portion of the traveler comprises a slot, the rod being disposed within the slot of the traveler.

9. The umbrella of claim 1, wherein the handle comprise a U-shaped projection and the traveler comprises a support pole interface and a flange extending radially away from the support pole interface, the U-shaped projection being pivotably mounted around the flange.

10. The umbrella of claim 1, wherein the support pole comprises a channel disposed therein, the rod being slideably disposed in the channel.

11. The umbrella of claim 1, wherein the upper portion of the support pole is extendable out of the lower portion of the support pole such that the upper of the upper portion can be moved away from the lower end of the lower portion, the upper end being coupled with the upper hub.

12. The umbrella of claim 1, wherein the support pole comprises a channel disposed therein, the rod being slideably disposed in the channel.

13. The umbrella of claim 1, wherein the support pole comprises a circular periphery and the channel comprises a C-shaped configuration disposed in the interior of the circular periphery, the channel being accessible through an elongate slot in the support pole.

14. The umbrella of claim 1, wherein the canopy frame comprises a middle hub disposed at an elevation between the upper hub and the lower hub, the middle hub coupled with a first end of a third rib, the third rib having a second end coupled with the second rib.

15. The umbrella of claim 14, wherein the middle hub is coupled to an upper end of the lower portion of the support pole, the upper portion of the support pole being extendable through the middle hub from the lower portion of the support pole.

16. The umbrella of claim 14, wherein the first rib, the second rib, and the third rib are connected to provide a weight balanced neutral position in which the actuator assembly is spaced away from an upper end of a range of motion of the traveler and a lower end of the range of motion of the traveler.

17. An umbrella, comprising:

a support pole comprising a lower portion having a lower end and an upper portion having an upper end;

a canopy frame coupled with the support pole, the canopy frame comprising:

an upper hub coupled with a first end of a first rib;

a lower hub coupled with a first end of a second rib, the second rib having a second end coupled with the first rib; and a movement assembly comprising:

a rod having a first end coupled with the canopy frame and a second end moveable along the support pole;

a traveler coupled with the second end of the rod;

a handle pivotably coupled with the traveler; and a locking device comprising:

a plurality of spaced apart recesses;

a locking pin moveable relative to the traveler, a first end of locking pin having a first position disposed in any one of the plurality of recesses and a second position spaced away from all of the recesses, the locking pin having a second end coupled with the handle;

wherein the handle is configured to move relative to the traveler to move the locking pin from the first position the second position to disengage the locking pin from the spaced apart recesses.

18. An umbrella, comprising:

a support pole;

a canopy frame coupled with the support pole;

a set up assembly coupled with the canopy frame, the set up assembly comprising:

an actuator handle;

a recess disposed on or in the support pole;

a locking pin coupled with the handle and moveable by the handle along a first direction between a first position disposed in the recess and a second position spaced away from the recess;

wherein movement of the locking pin along the umbrella pole adjacent to the recess in a second direction transverse to the first direction moves the locking pin between the first position and the second position in the first direction without moving the actuator handle in the first direction;

wherein a slot in the locking pin allows the locking pin to move in the first direction without corresponding motion of the handle in the first direction.

19. The umbrella of claim 18, wherein the recess is disposed between a plurality of ratchet features coupled with the support pole and wherein the ratchet features move the locking pin in the first direction between the first position and the second position during movement of the locking pin in the second direction.

20. The umbrella of claim 18, wherein an axle coupled to the actuator handle and to the locking pin transfers movement of the handle in the first direction to the locking pin.

* * * * *